US011105560B2

(12) United States Patent
Masgrau

(10) Patent No.: US 11,105,560 B2
(45) Date of Patent: Aug. 31, 2021

(54) HEAT EXCHANGER

(71) Applicant: InnoHeat Sweden AB, Malmö (SE)

(72) Inventor: Marcello Masgrau, Copenhagen (DK)

(73) Assignee: INNOHEAT SWEDEN AB

( * ) Notice: Subject to any disclaimer, the term of this patent is extended or adjusted under 35 U.S.C. 154(b) by 69 days.

(21) Appl. No.: 16/637,757

(22) PCT Filed: Aug. 21, 2018

(86) PCT No.: PCT/EP2018/072553
§ 371 (c)(1),
(2) Date: Feb. 9, 2020

(87) PCT Pub. No.: WO2019/038279
PCT Pub. Date: Feb. 28, 2019

(65) Prior Publication Data

US 2020/0166283 A1 May 28, 2020

(30) Foreign Application Priority Data

Aug. 22, 2017 (EP) ..... 17187363

(51) Int. Cl.
*F28F 3/00* (2006.01)
*F28D 9/00* (2006.01)
(Continued)

(52) U.S. Cl.
CPC ..... *F28D 9/0056* (2013.01); *F28F 3/046* (2013.01); *F28F 3/086* (2013.01)

(58) Field of Classification Search
CPC ..... F28D 9/005; F28D 9/0056; F28D 9/0037; F28F 3/046; F28F 3/086
(Continued)

(56) References Cited

U.S. PATENT DOCUMENTS 4,073,340 A * 2/1978 Parker ..... F28D 9/00 165/166
4,688,631 A * 8/1987 Peze ..... F28D 9/0037 165/166
(Continued)

FOREIGN PATENT DOCUMENTS

CN 1771420 A 5/2006
CN 101405554 A 4/2009
(Continued)

OTHER PUBLICATIONS

International Search Report from corresponding International Application No. PCT/EP2018/072553, dated Jun. 11, 2018, 2 pages.

*Primary Examiner* — Claire E Rojohn, III
(74) *Attorney, Agent, or Firm* — Tucker Ellis LLP

(57) ABSTRACT

Heat exchanger (100) for heat exchange between a first medium and a second medium, comprising a main inlet (101) and a main outlet (102) for the first medium; and a plurality of heat exchanging plates (110), each of which comprising a plate inlet (111) and a plate outlet (112) for the first medium; and a respective first heat transfer surface (114) on a first side (113) and arranged to be in contact with the first medium flowing along said first side; a respective second heat transfer surface (116) on a second side (115) and arranged to be in contact with the second medium flowing along said second side; a respective plurality of indentations (120,130,140); wherein the plates are fastened together in a stack, comprising plates of a first type (104*a*) and plates of a second type (104*b*) arranged alternatingly, whereby corresponding ones of said indentations of adjacent plates are arranged in direct abutting contact with each other, so that flow channels (105',105",106) for said first and second media are formed between said surfaces. The invention is characterised in that each plate of the first type comprises a respective ridge-shaped indentation (120), arranged to form
(Continued)

Figure 1A:
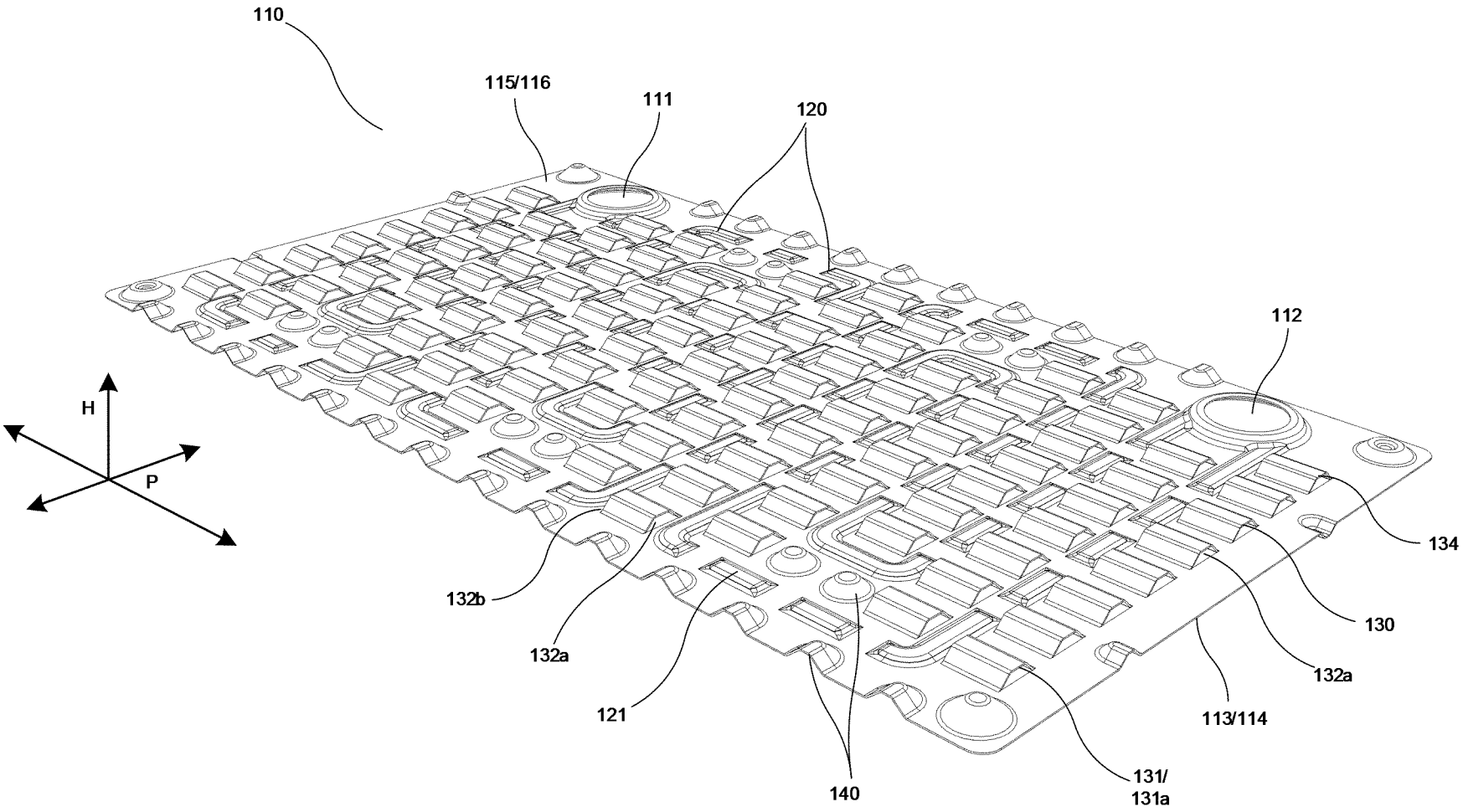

a closed flow first medium channel (105',105"), in that each plate of the first type comprises a respective bridge-shaped indentation (130), formed to comprise a through hole (132*a*, 132*b*) arranged to form an open flow channel (106) for the second medium, and in that said open flow channel communicates with corresponding open flow channels between other pairs of first and second type plates.

16 Claims, 33 Drawing Sheets

(51) Int. Cl.
*F28F 3/04* (2006.01)
*F28F 3/08* (2006.01)

(58) Field of Classification Search
USPC ..... 165/166
See application file for complete search history.

(56) References Cited

U.S. PATENT DOCUMENTS 10,876,794 B2 * 12/2020 Bergh ..... F28D 9/0006
2005/0016719 A1 * 1/2005 Blomgren ..... F28F 3/046 165/165
2006/0144052 A1 * 7/2006 Callas ..... F28F 3/046 62/3.7
2006/0289152 A1 * 12/2006 Leuschner ..... F28F 1/126 165/152
2007/0044946 A1 * 3/2007 Mehendale ..... F28F 3/044 165/153
2009/0133861 A1 * 5/2009 Kim ..... F24H 1/48 165/140
2009/0151917 A1 * 6/2009 Meschke ..... F28D 9/005 165/168
2010/0065262 A1 * 3/2010 Platt ..... F28D 9/005 165/164
2010/0218927 A1 * 9/2010 Cooper ..... F28D 19/042 165/185
2010/0263843 A1 * 10/2010 Chang ..... F28F 3/046 165/133
2011/0024097 A1 * 2/2011 Christensen ..... F28F 3/046 165/166
2011/0042035 A1 * 2/2011 Seebald ..... F28D 19/044 165/8
2011/0088882 A1 * 4/2011 Persson ..... F28D 9/005 165/167
2011/0108258 A1 * 5/2011 Magnier-Cathenod ..... F28F 3/046 165/167
2011/0290462 A1 * 12/2011 Andersson ..... F28D 9/005 165/170
2011/0308779 A1 * 12/2011 Andersson ..... F28D 9/005 165/170
2012/0305217 A1 * 12/2012 Cowburn ..... F28D 19/044 165/67
2012/0325434 A1 * 12/2012 Blomgren ..... F28F 3/046 165/104.19
2013/0087317 A1 * 4/2013 Papoulis ..... F28F 3/044 165/177
2013/0113126 A1 * 5/2013 Mockry ..... F28C 1/16 261/112.1
2013/0113127 A1 * 5/2013 Yang ..... F28F 9/0075 261/112.1
2013/0126135 A1 * 5/2013 Romlund ..... F28F 3/046 165/133
2013/0180699 A1 * 7/2013 Dahlberg ..... F28D 9/0031 165/185
2013/0209322 A1 * 8/2013 Gaiser ..... F28D 20/02 422/175
2013/0233518 A1 * 9/2013 Liu ..... F28D 15/04 165/104.26
2014/0076527 A1 * 3/2014 Grinbergs ..... F28D 21/0014 165/166
2014/0158328 A1 * 6/2014 Persson ..... F28F 3/042 165/109.1
2015/0021002 A1 * 1/2015 Hoglund ..... F28F 13/12 165/133
2016/0265852 A1 * 9/2016 Kalbacher ..... F28D 9/005
2016/0363399 A1 * 12/2016 Kim ..... F28F 27/02
2017/0030661 A1 * 2/2017 Ariyama ..... F28D 9/005
2017/0038150 A1 * 2/2017 Kalbacher ..... F28D 9/005
2017/0176047 A1 * 6/2017 Kondo ..... B23P 15/26
2018/0292145 A1 * 10/2018 Sun ..... F28D 15/0266
2018/0363991 A1 * 12/2018 Cukurel ..... F01D 5/00
2020/0049420 A1 * 2/2020 Liu ..... F28D 15/046
2020/0153062 A1 * 5/2020 Collins ..... H01M 10/617
2020/0200484 A1 * 6/2020 Zhou ..... F28F 3/12
2020/0386493 A1 * 12/2020 Noren ..... F28D 9/005
2021/0033349 A1 * 2/2021 Choi ..... F28D 9/005
2021/0131750 A1 * 5/2021 Nielsen ..... F28F 3/083

FOREIGN PATENT DOCUMENTS

CN 101476830 A 7/2009
CN 103868380 A 6/2014
CN 105637313 A 6/2016
DE 1501607 A1 3/1970
EP 0186592 B1 10/1988
EP 2682702 B1 4/2017
EP 3660438 A1 3/2020
WO 20070110196 A1 10/2007
WO 20150057115 A1 4/2015

* cited by examiner

HEAT EXCHANGER

The present invention relates to a stacked-plate heat exchanger, which is particularly useful for heat exchanging a first medium in the form of a liquid to a second medium in the form of a gas. A particularly advantageous application of the present heat exchanger is for air coolers.

The invention also relates to heat exchanging plate designs that are particularly suited for use in such heat exchangers.

Stacked-plate heat exchangers are known as such and for many different applications, for instance from EP2682702B1 and EP0186592B1. Such stacked-plate heat exchangers may be arranged with flow channels for different media to be heat exchanged, being formed between adjacent heat exchanging plates in a stack of such plates, and in particular delimited by corresponding heat exchanging surfaces on such plates.

The plates are known to be manufactured from relatively thin, stamped sheet metal pieces, which metal pieces can be joined to form the heat exchanger. Such heat exchangers can be made relatively efficient. Dimples arranged on the plates and in contact with each other across plates provide good mechanical stability for such heat exchangers.

Individual heat exchanging plates are furthermore known to be provided with through holes for passage of a heat-exchanged medium. This is shown, for instance, in DE1501607A1.

In many heat exchanging applications, in particular when heat exchanging a gaseous medium to another medium, there is a trade-off between adequate mechanical stability and a desired low gas pressure drop through the heat exchanges. The more contacting dimples or other connecting indentations in the gas passage channels between plates, the higher mechanical stability, but also the higher pressure drop. It would be desirable to provide a heat exchanger with both high mechanical stability and low pressure drop.

Such a heat exchanger should also offer high thermal heat exchanging efficiency while being able to maintain a large throughput of heat-exchanged media.

Furthermore, such a heat exchanger should be easy to produce with high reliability in terms of final product quality.

The present invention solves the above described problems.

Hence, the invention relates to a heat exchanger for heat exchange between a first medium and a second medium, comprising a main inlet for the first medium; a main outlet for the first medium; and a plurality of heat exchanging plates, which plates are associated with a respective substantially parallel main plane of extension and a height direction perpendicular to said main plane, and each of which plates comprising a plate inlet for the first medium, connected to the main inlet for the first medium; a plate outlet for the first medium, connected to the main outlet for the first medium; and a respective first heat transfer surface on a first side of the plate in question and arranged to be in contact with the first medium flowing along said first side; a respective second heat transfer surface on a second side of the plate in question and arranged to be in contact with the second medium flowing along said second side; a respective plurality of indentations in the plate in question, formed by the material of the plate in question bulging out locally in the said plate height (H) direction; wherein the plates are fastened together in a stack on top of each other with their respective main planes substantially parallelly arranged, comprising plates of a first type and plates of a second type arranged alternatingly, whereby corresponding ones of said indentations of adjacent plates are arranged in direct contact with each other, so that at least one of corresponding first and second surfaces of adjacent plates abut each other via said indentations and so that flow channels for said first and second media are formed between said surfaces, and is characterised in that each plate of the first type comprises a respective ridge-shaped indentation, arranged to form, together with a corresponding ridge-shaped indentation of an adjacent plate of the second type, at least one closed flow channel for the first medium from the first medium plate inlet to the first medium plate outlet, in that each plate of the first type comprises a respective bridge-shaped indentation, formed to comprise a through hole through the plate in question and arranged to form, together with a corresponding bridge-shaped indentation of an adjacent plate of the second type, an open flow channel for the second medium, and in that said open flow channel communicates with corresponding open flow channels between other pairs of first and second type plates.

Figure 1B:
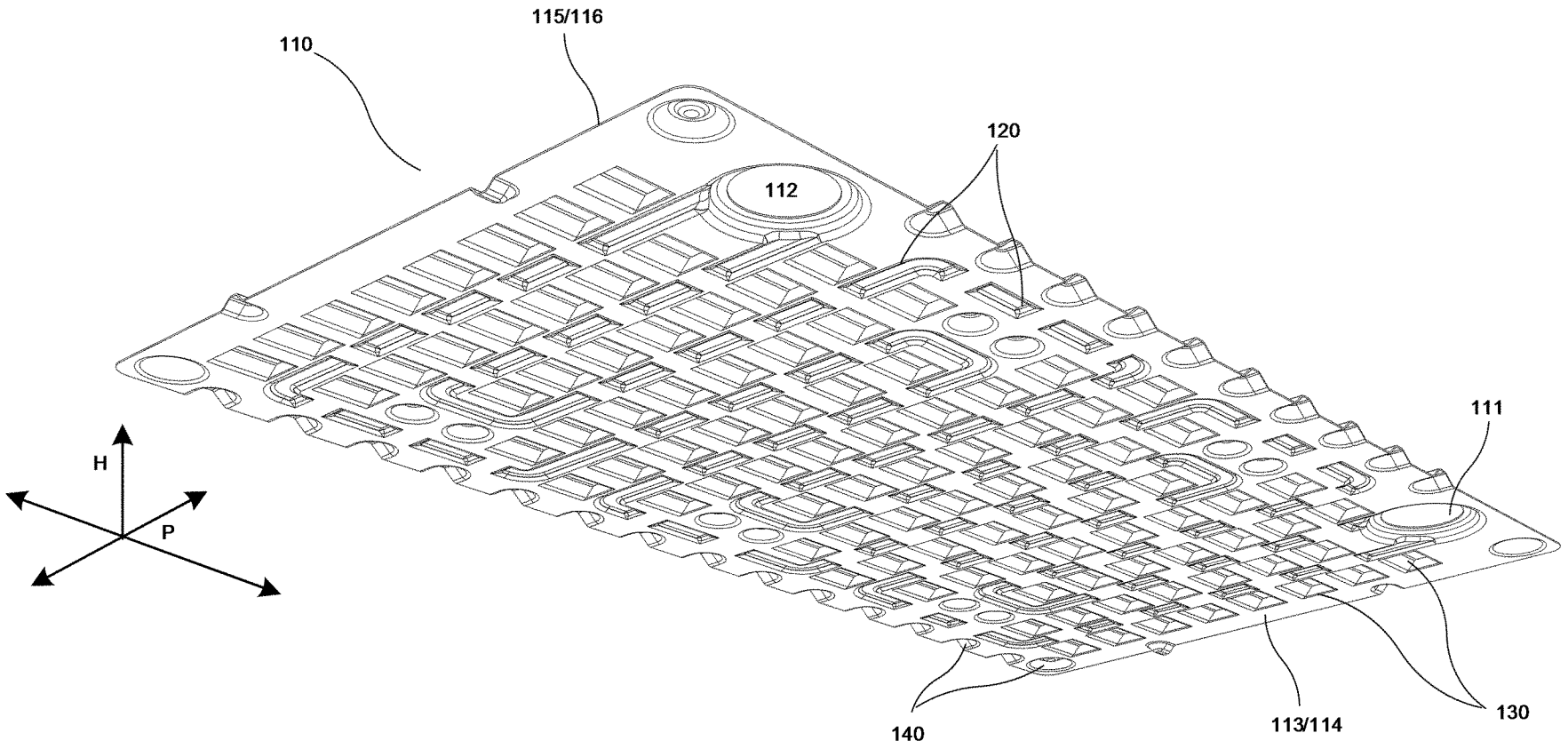
Figure 1C:
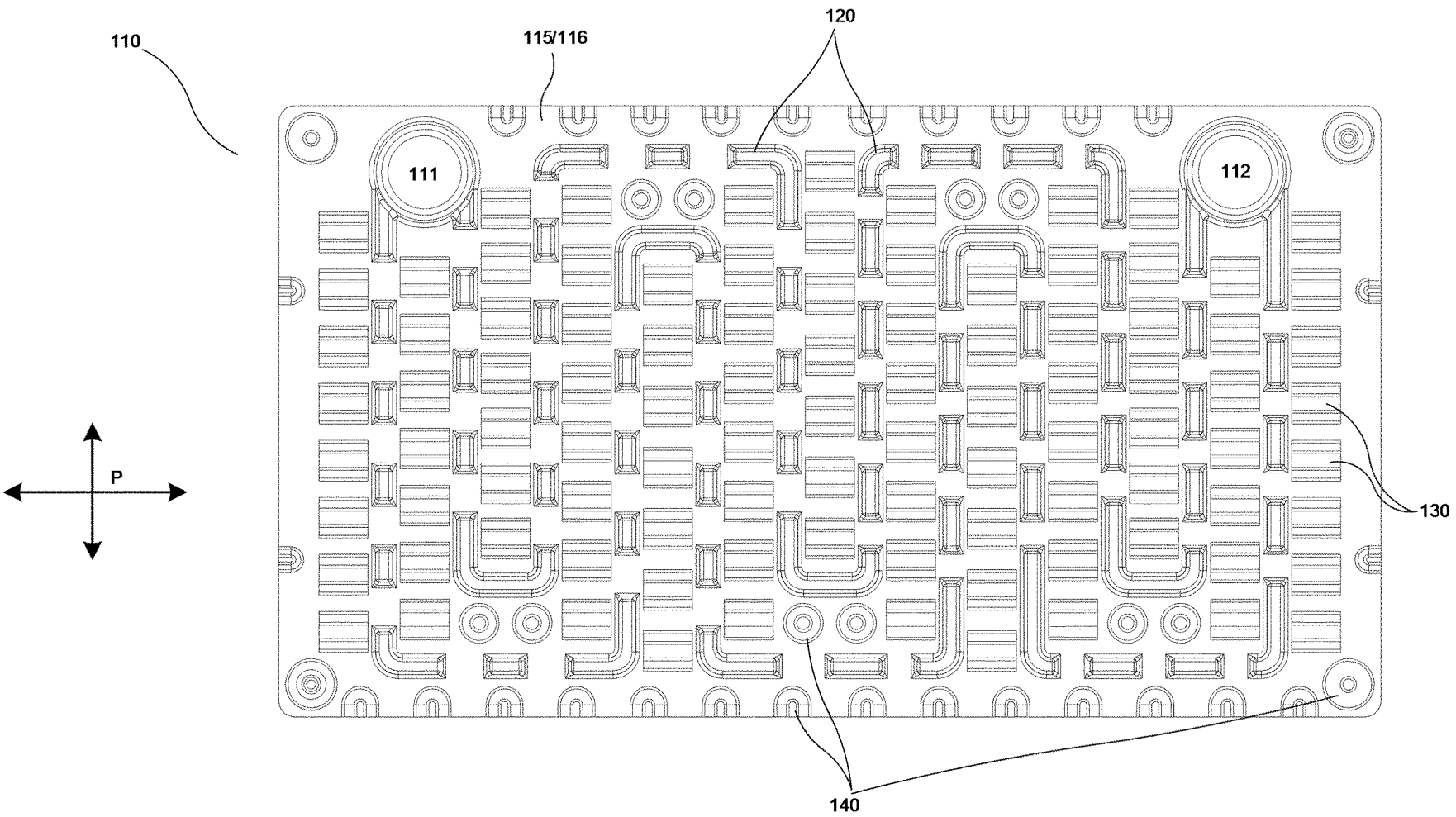
Figure 1D:
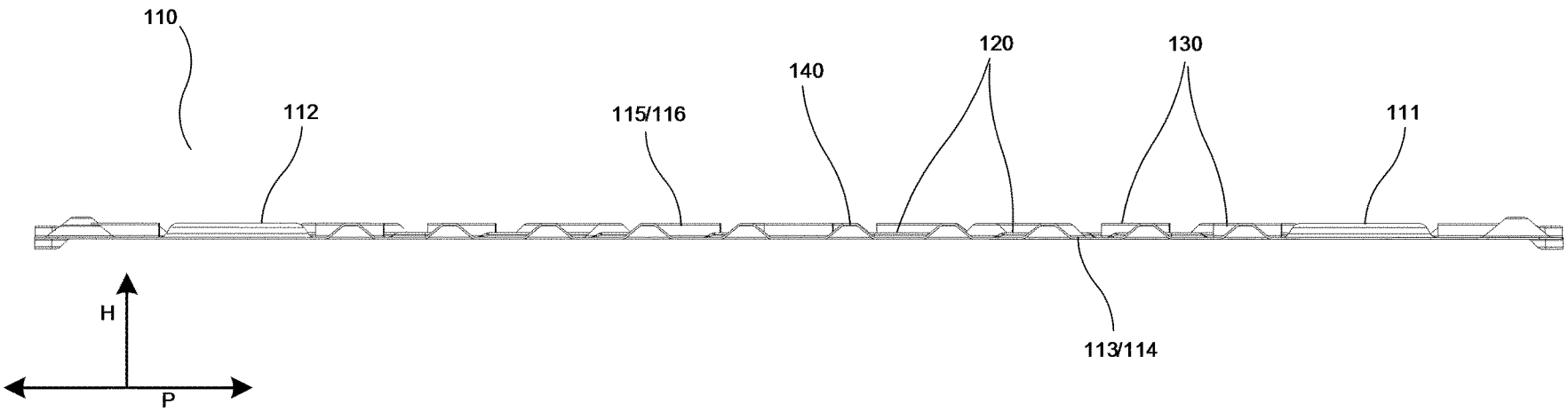
Figure 1E:
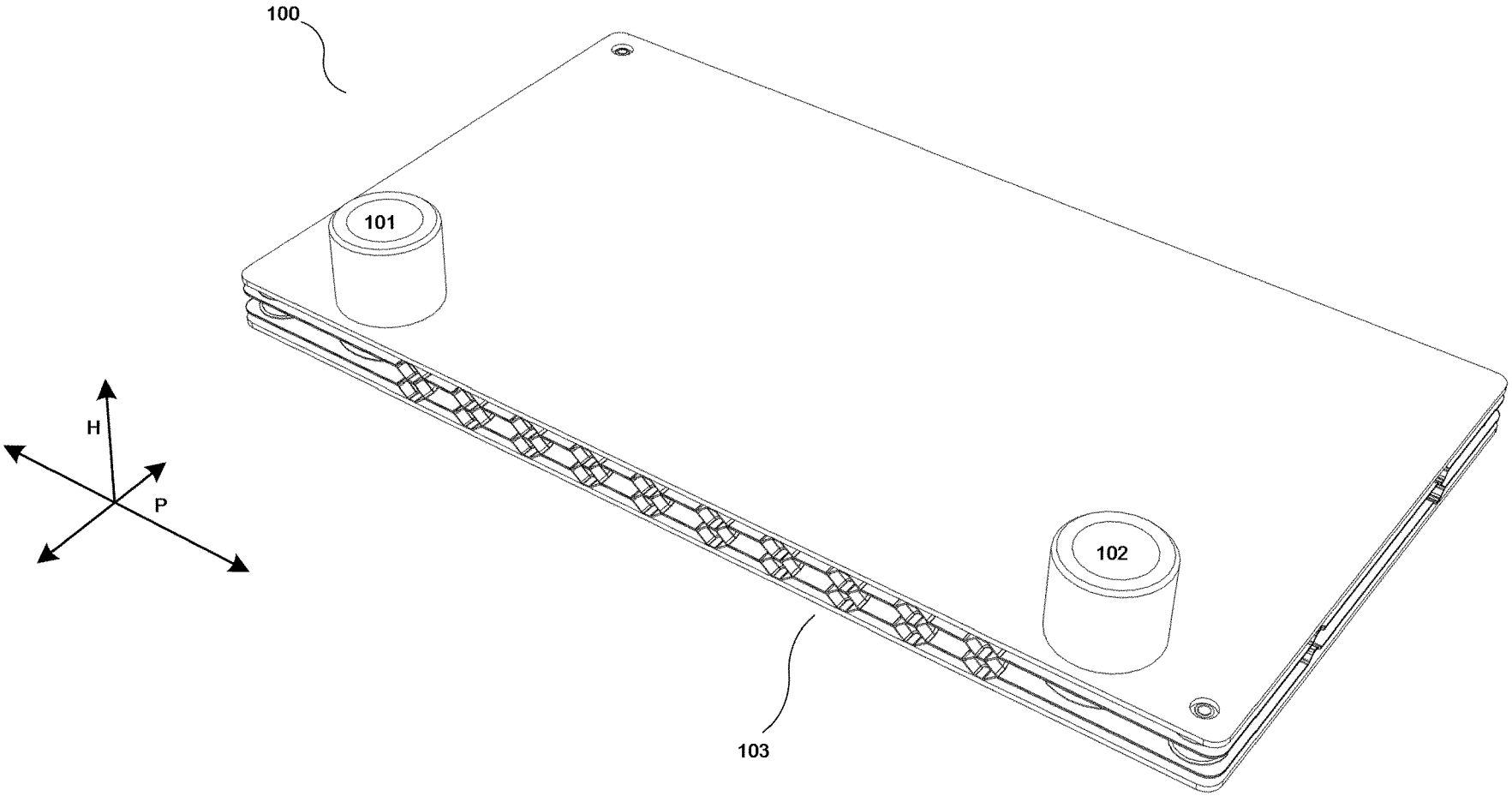
Figure 1F:
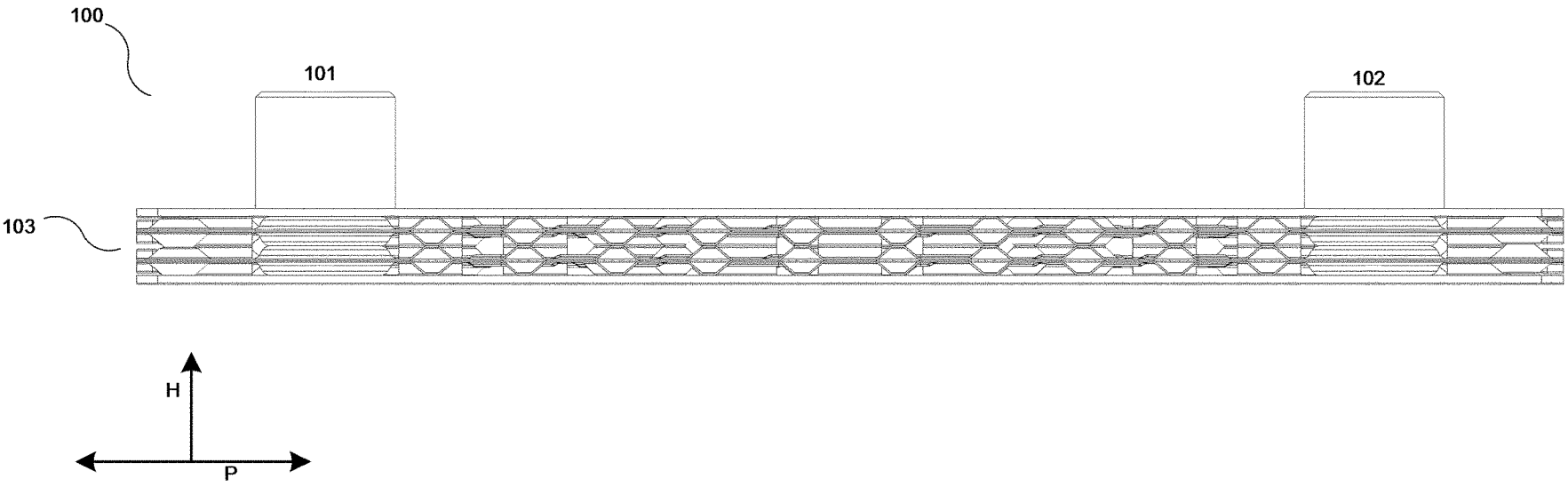
Figure 1G:
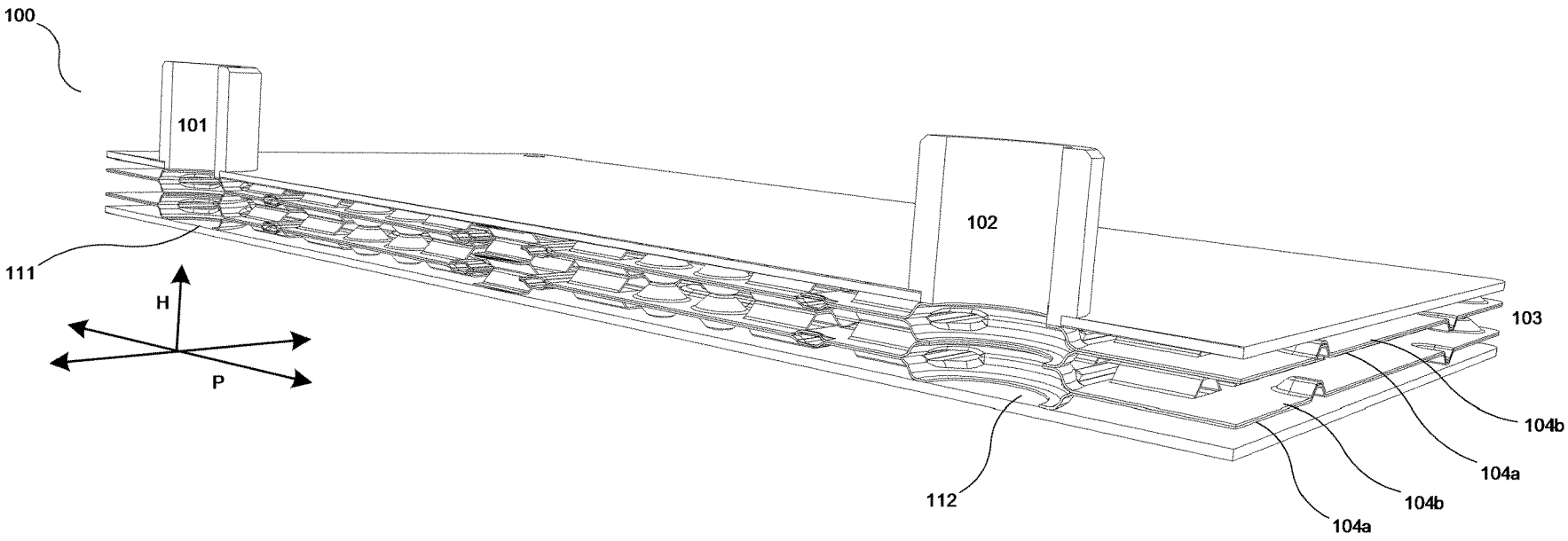
Figure 1H:
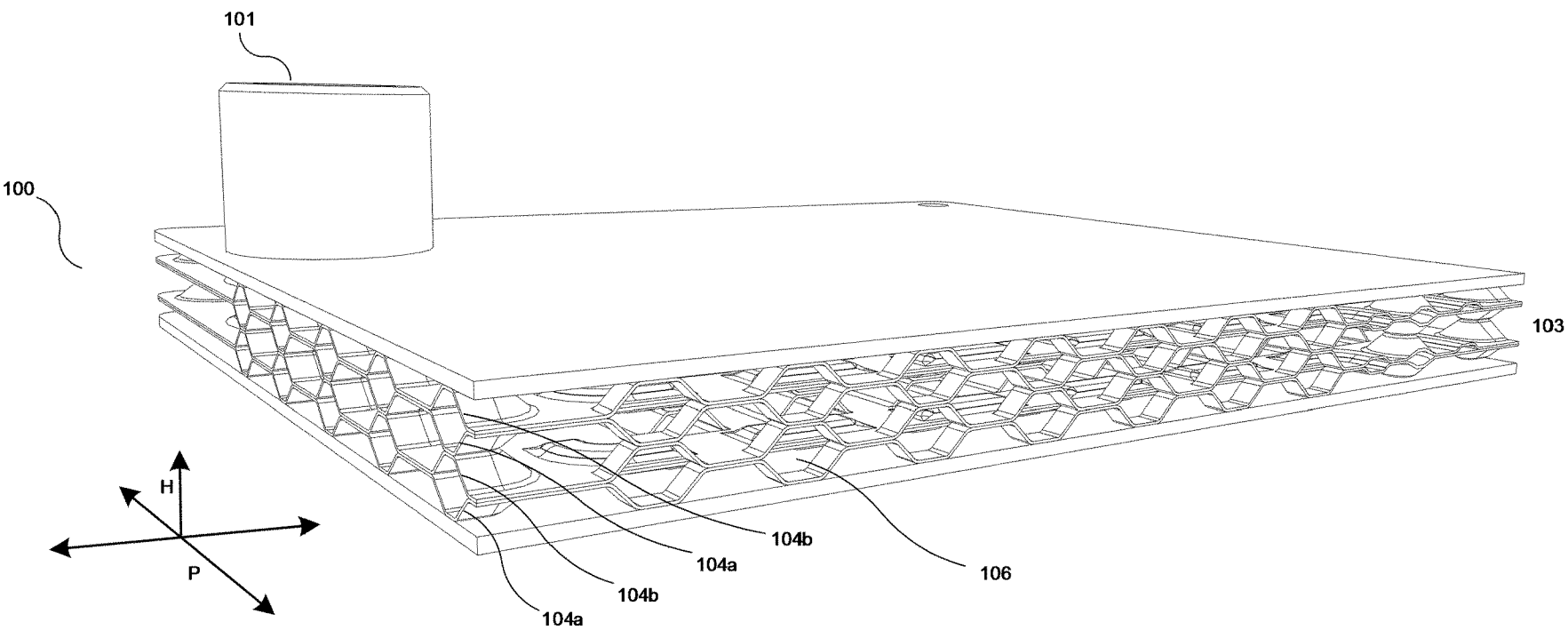
Figure 1I:
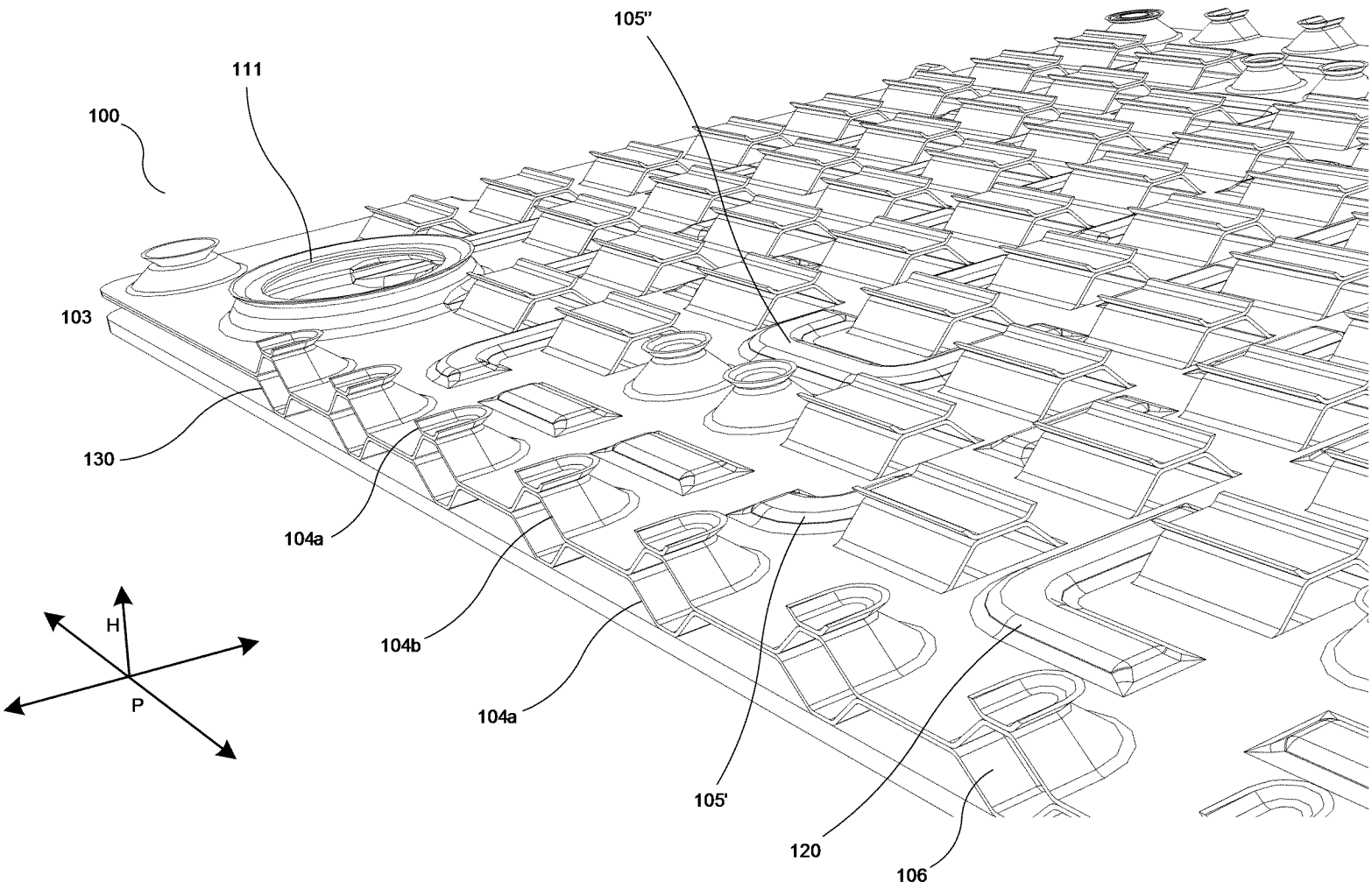
Figure 1J:
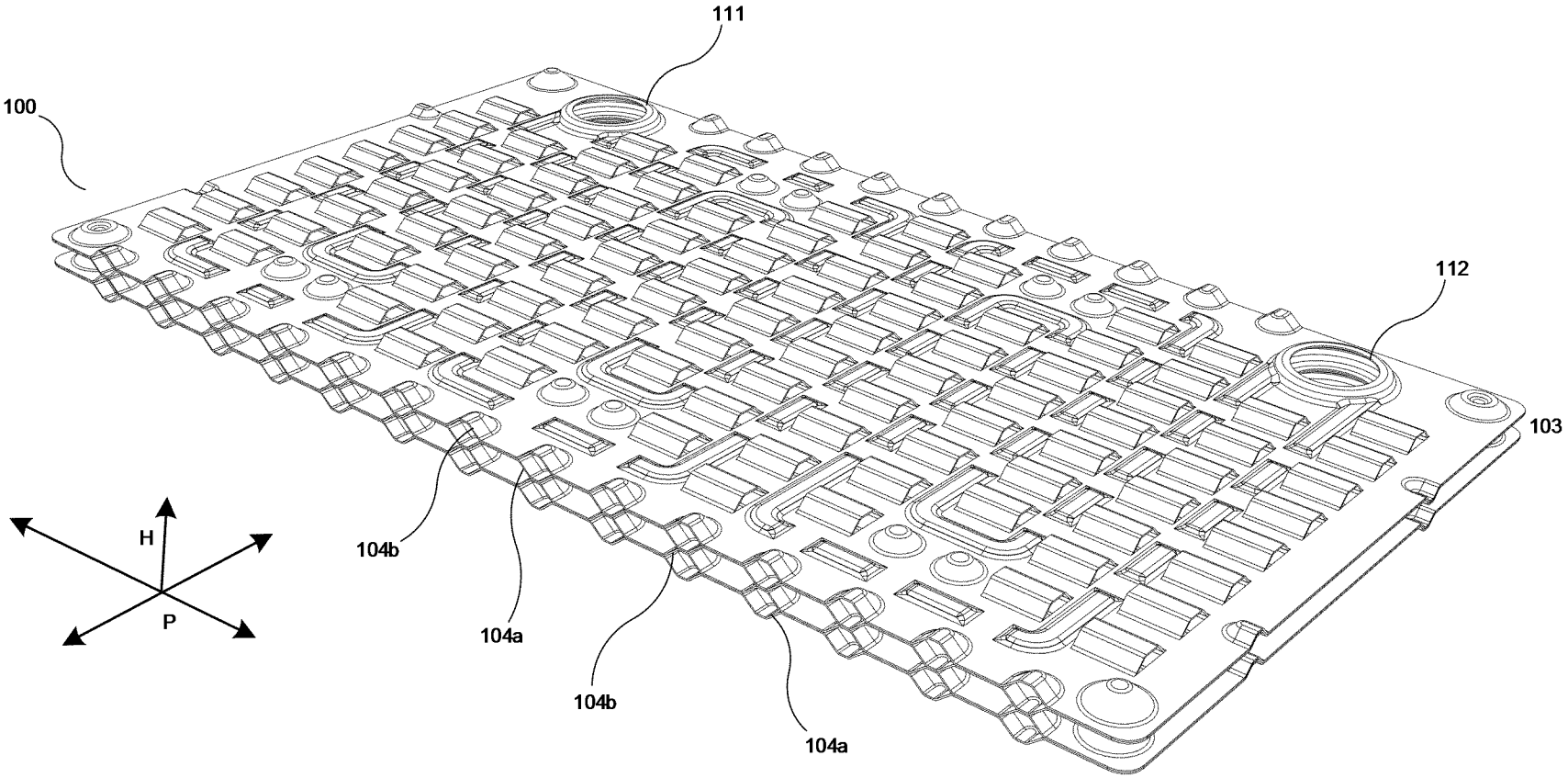
Figure 1K:
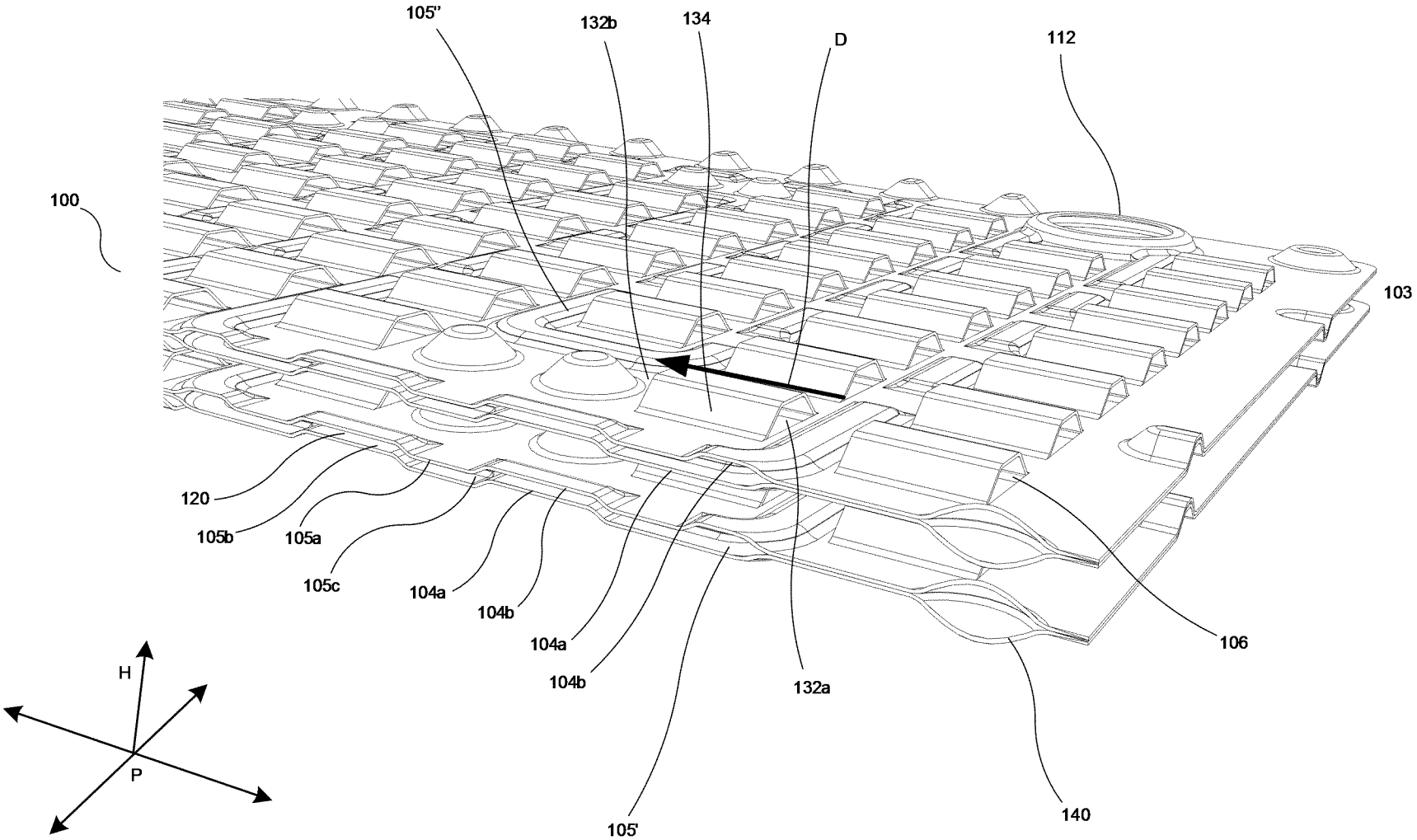

In the following, the invention will be described in detail, with reference to exemplifying embodiments of the invention and to the enclosed drawings, wherein:

FIG. 1*a* is a perspective view showing a first heat exchanging plate according to the invention, as seen from a top side of said first plate, showing a second surface of the first plate;

FIG. 1*b* is a perspective view showing the first plate from a bottom side, showing a first surface of the first plate;

FIG. 1*c* is plan top view of the first plate;

FIG. 1*d* is a plan side view of the first plate;

FIG. 1*e* is a perspective view of a first heat exchanger according to the invention, comprising the first plate;

FIG. 1*f* is a plan side view of the first heat exchanger;

FIG. 1*g* is a perspective cross-sectional view of the first heat exchanger, with the cross-section taken perpendicularly to a main plane of the first plate and parallel to a second medium general flow direction of the first heat exchanger;

FIG. 1*h* is a perspective cross-sectional view of the first heat exchanger, with the cross-section taken perpendicularly to a main plane of the first plate and perpendicular to a second medium general flow direction of the first heat exchanger;

FIG. 1*i* is a perspective cross-sectional view of the first heat exchanger, with the cross-section taken parallel to a main plane of the first plate, which cross-section is taken through a plate rather than between plates;

FIG. 1*j* is a perspective view of a heat exchanging plate stack comprised in the first heat exchanger;

FIG. 1*k* is a detail of the perspective of FIG. 1*j;*

Figure 2A:
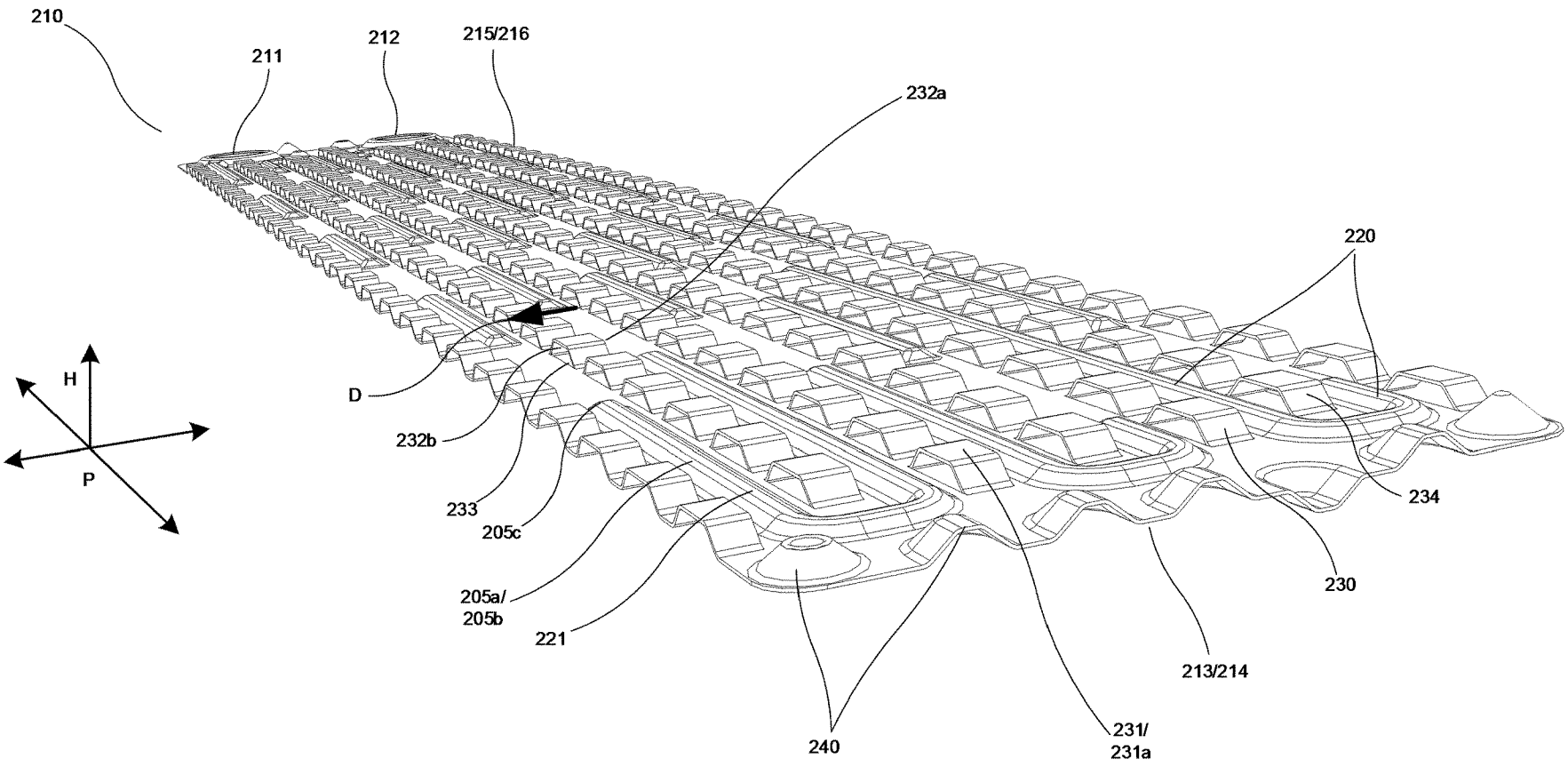
Figure 2B:
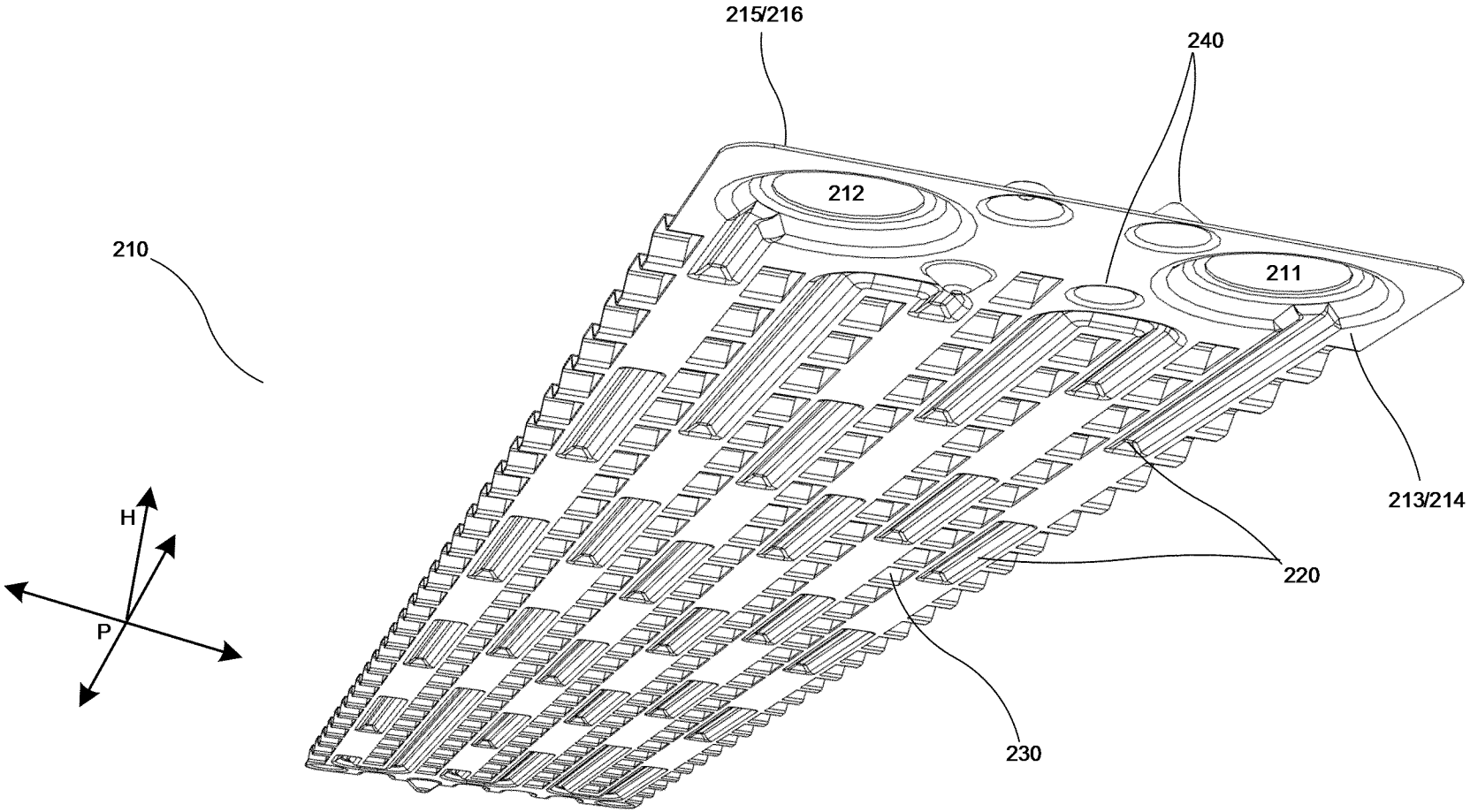
Figure 2C:
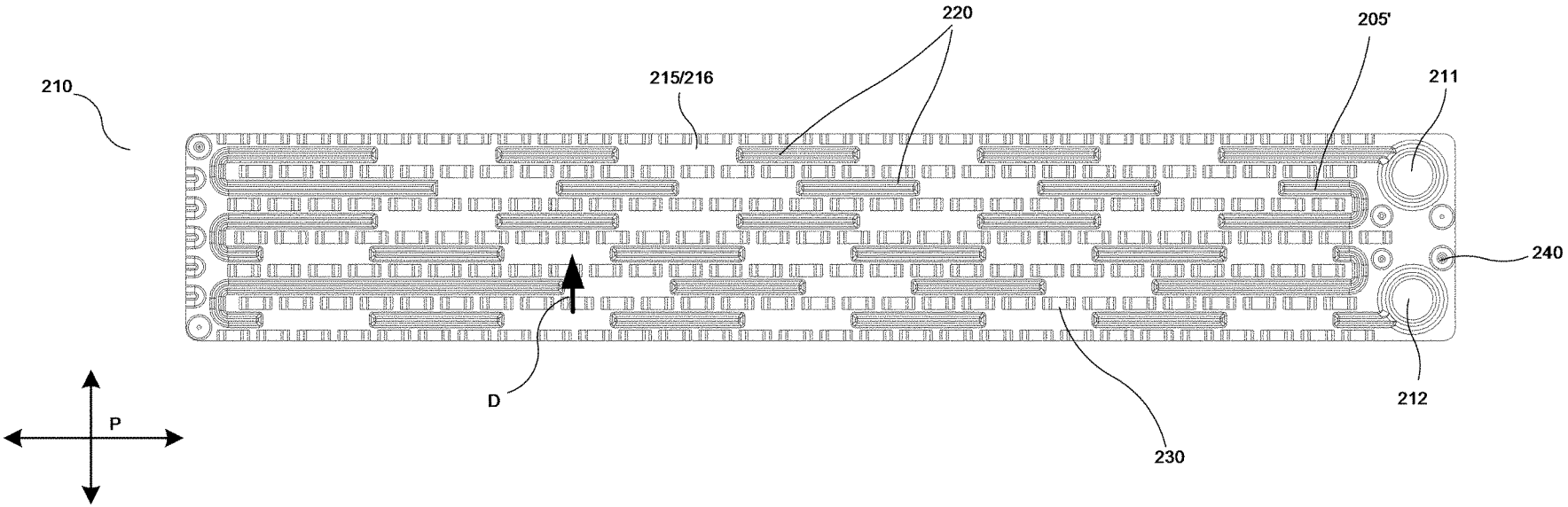
Figure 2D:
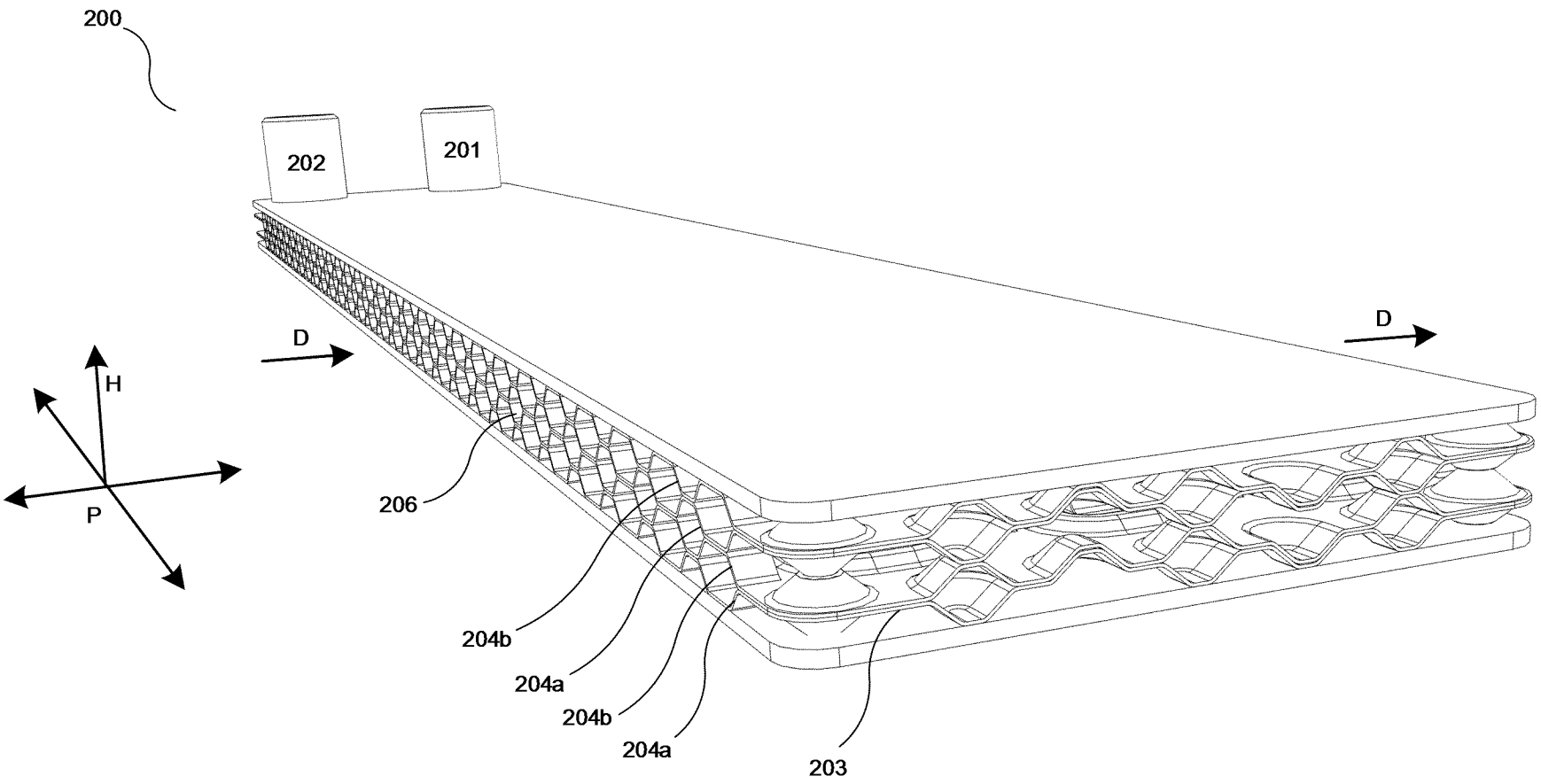
Figure 2E:
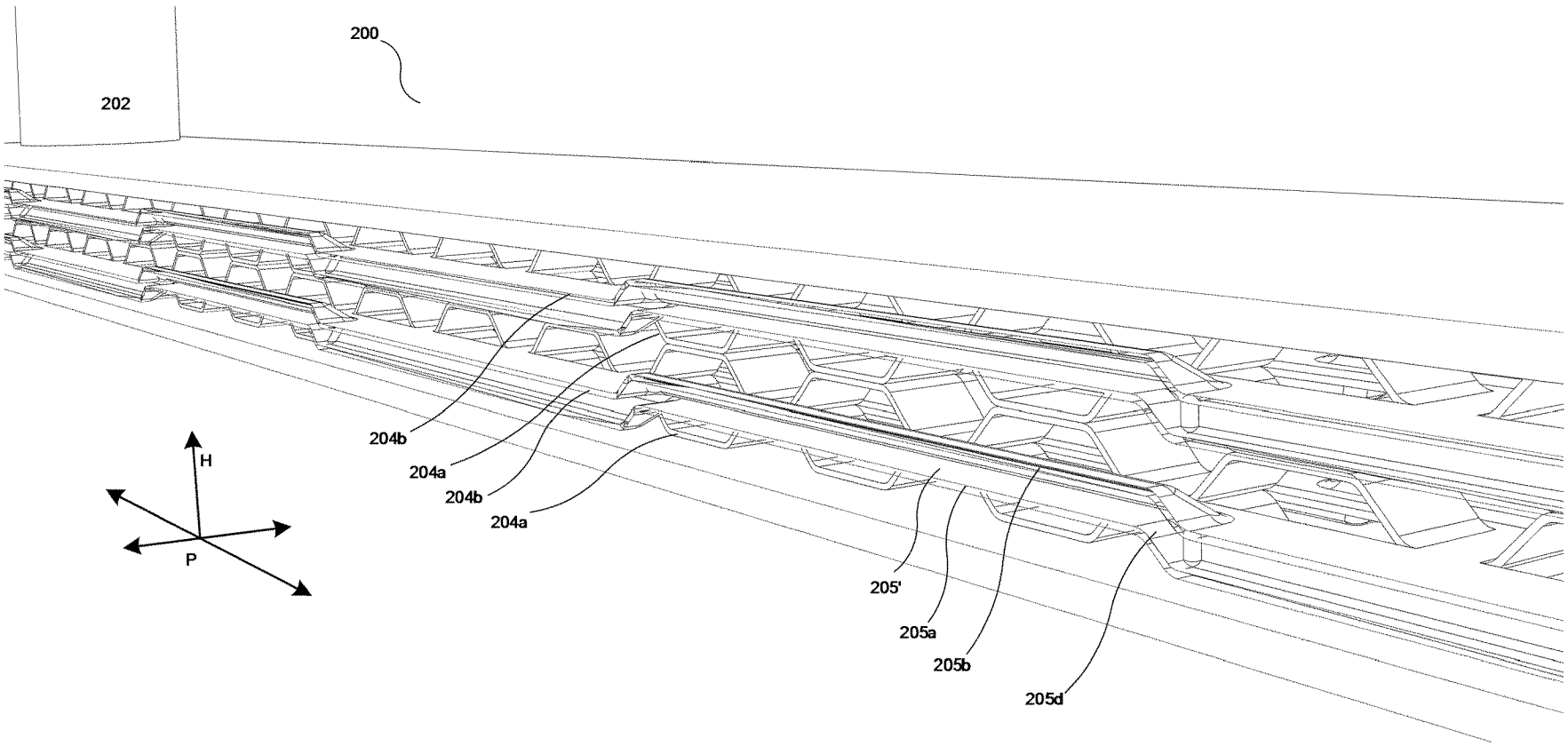
Figure 3A:
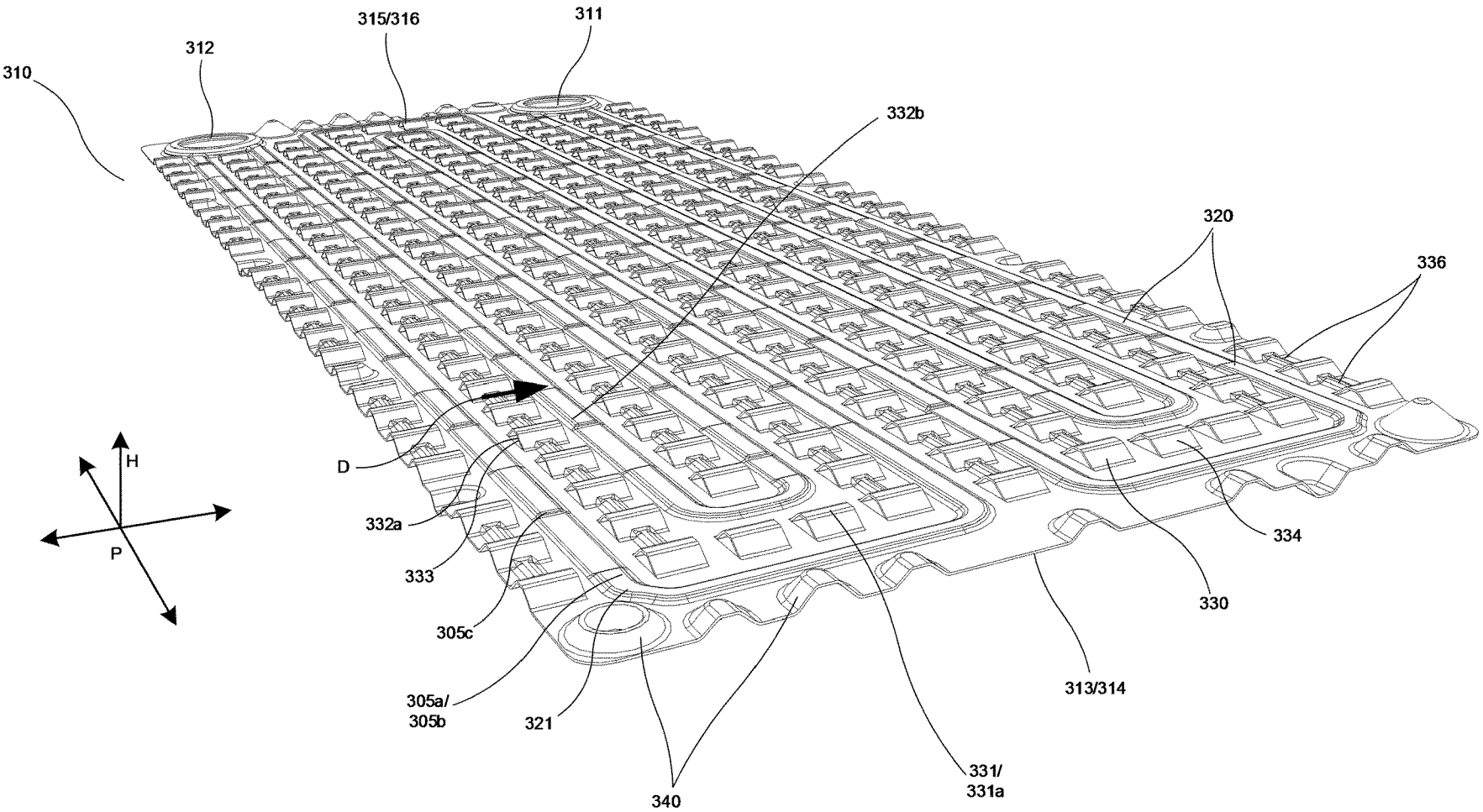
Figure 3B:
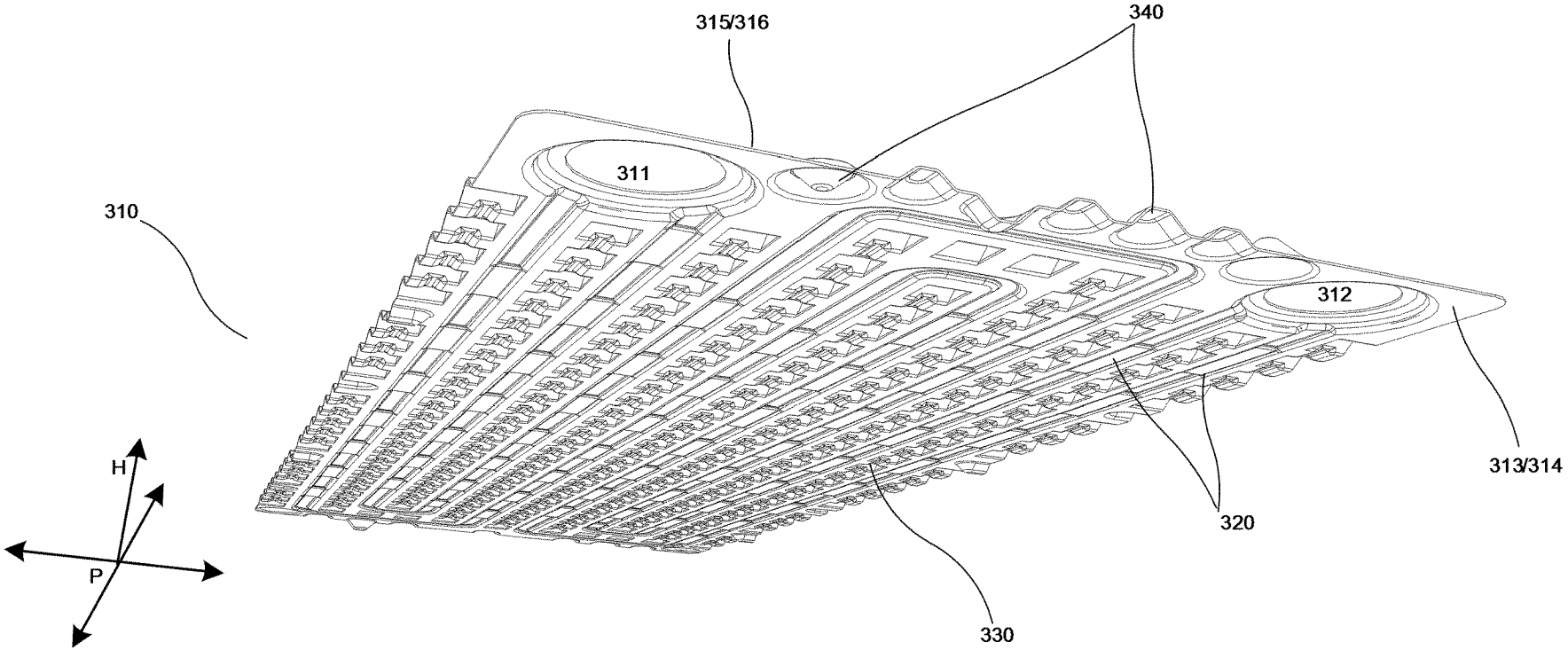
Figure 3C:
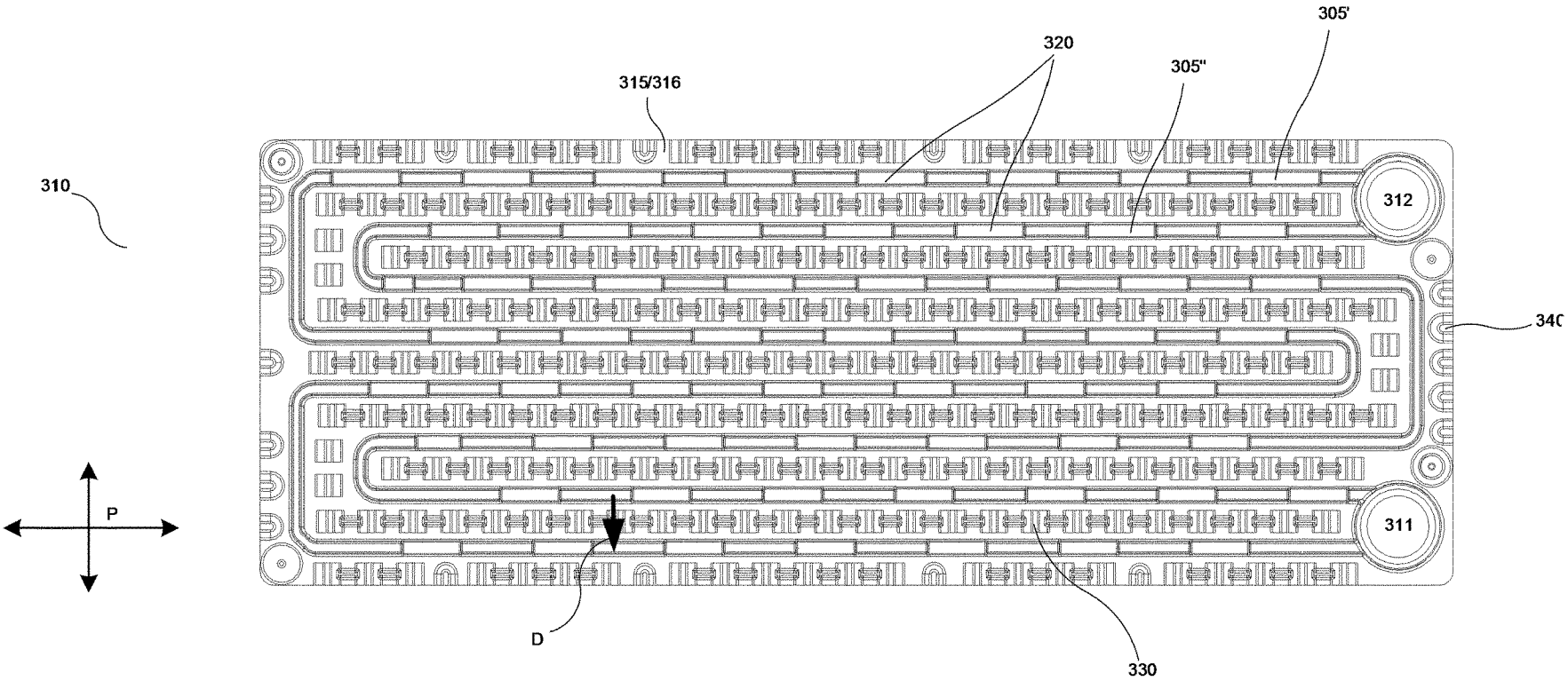
Figure 3D:
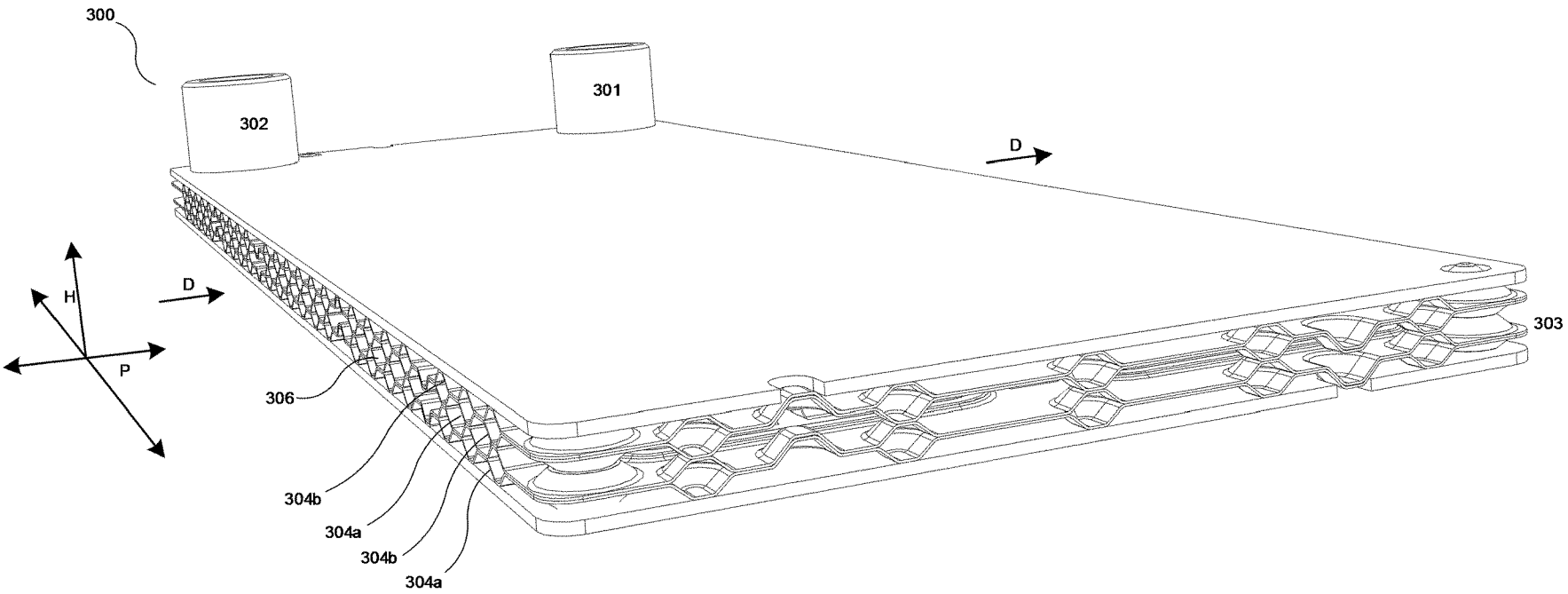
Figure 4A:
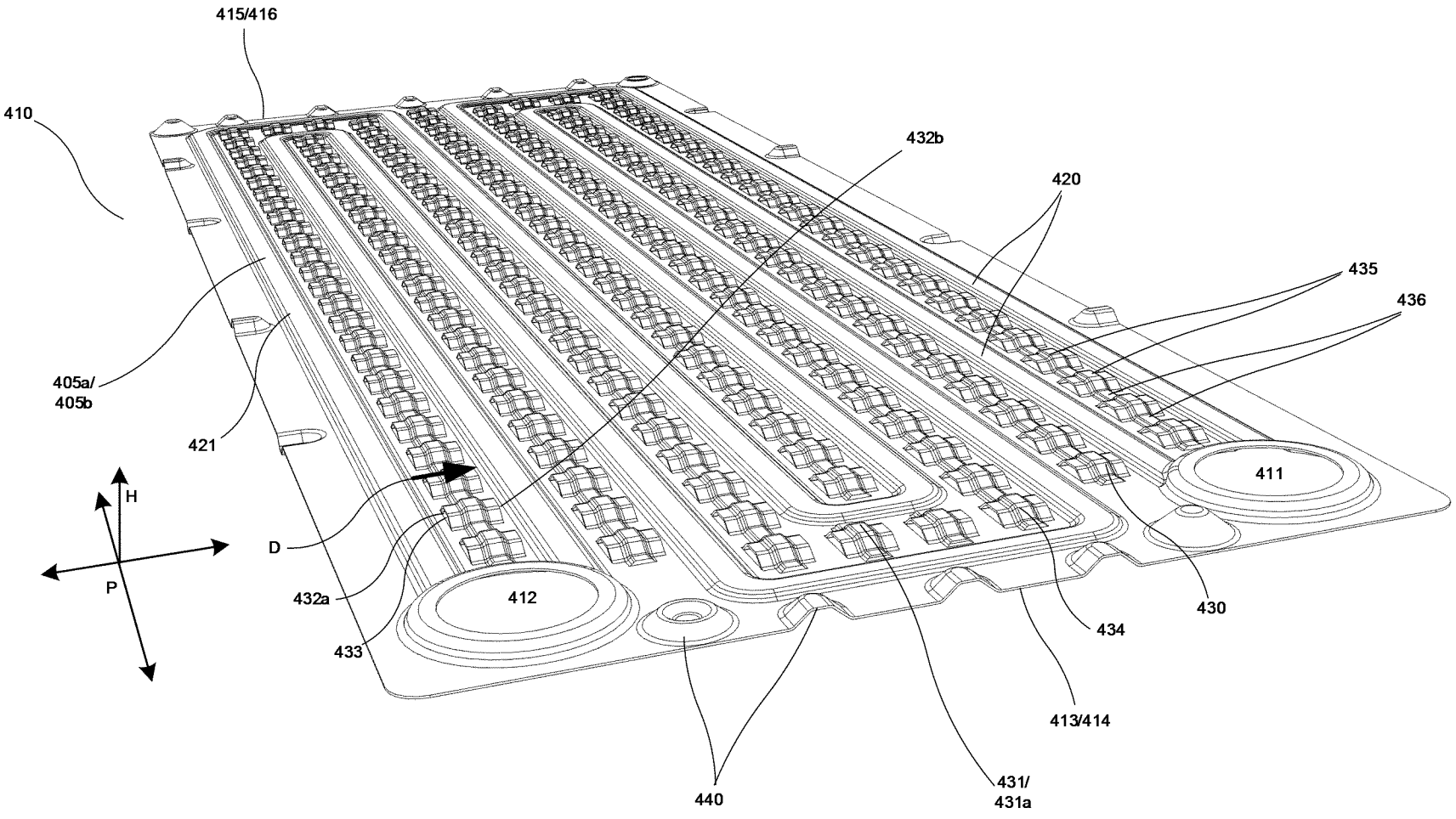
Figure 4B:
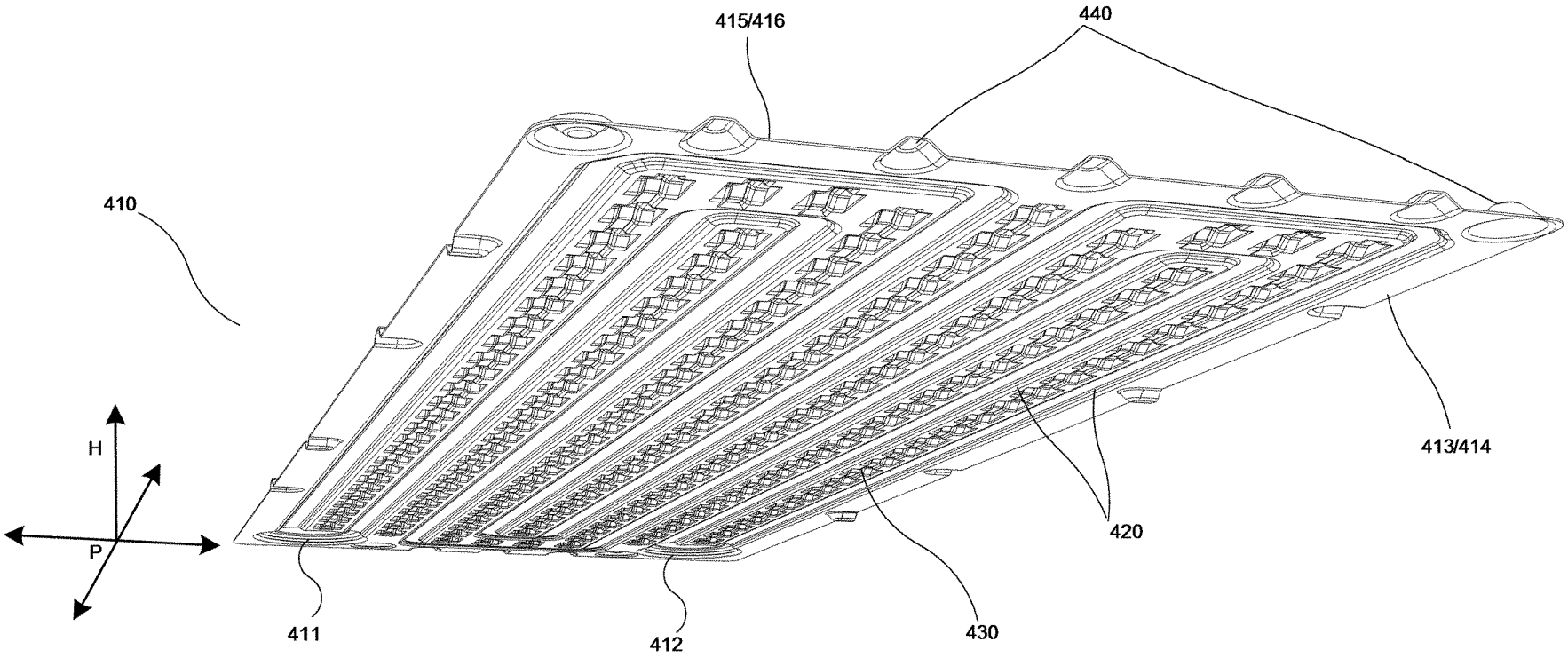
Figure 4C:
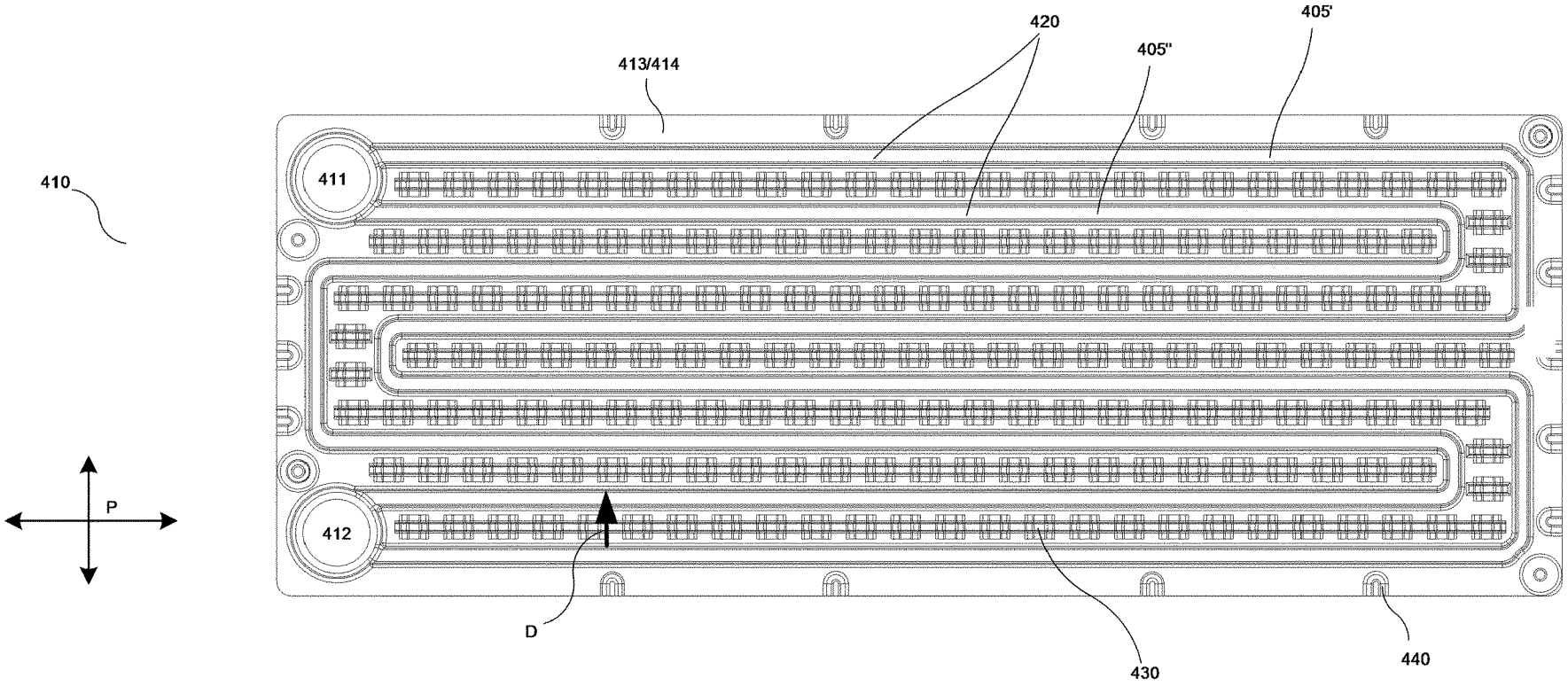
Figure 4D:
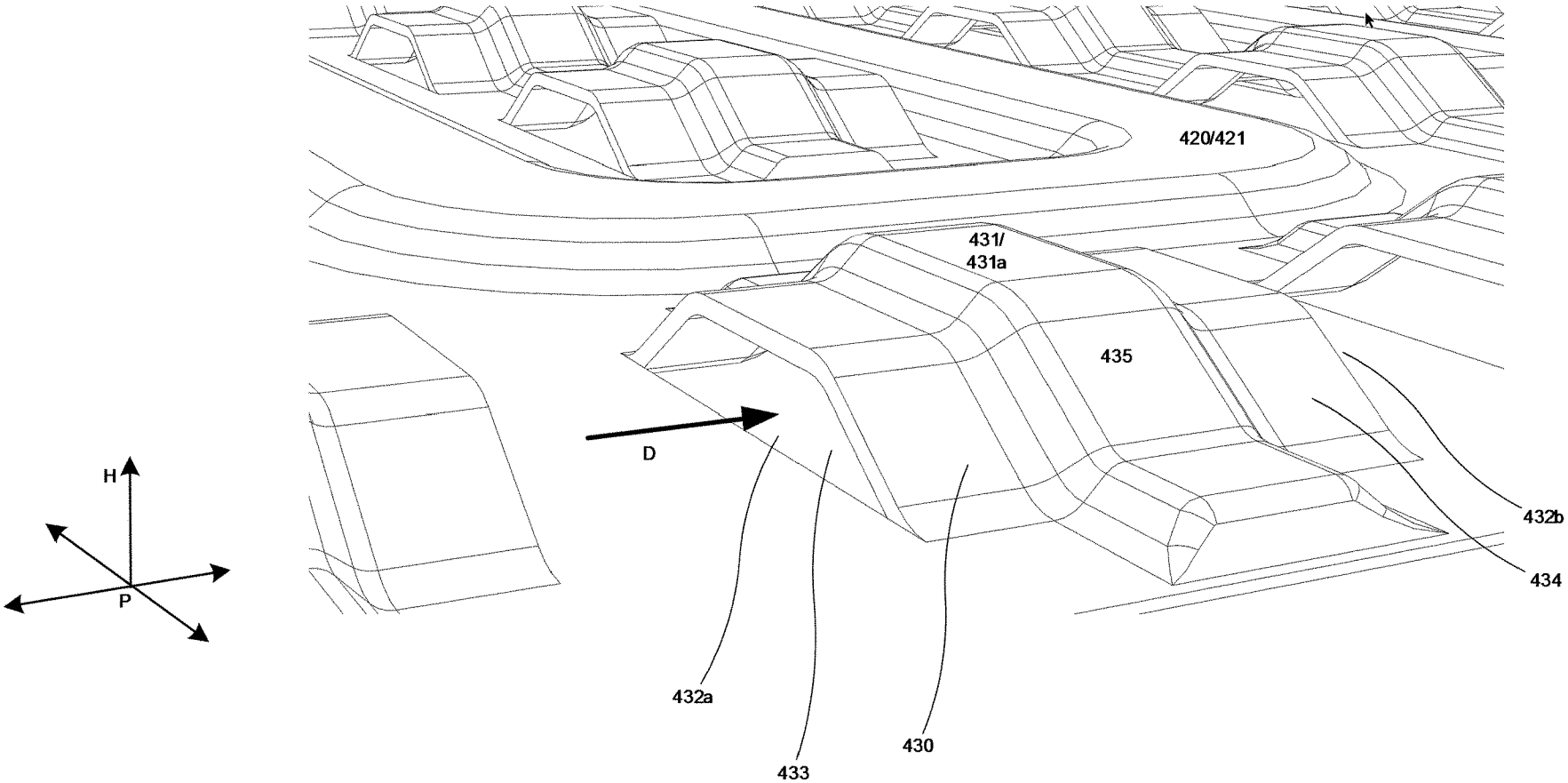
Figure 4E:
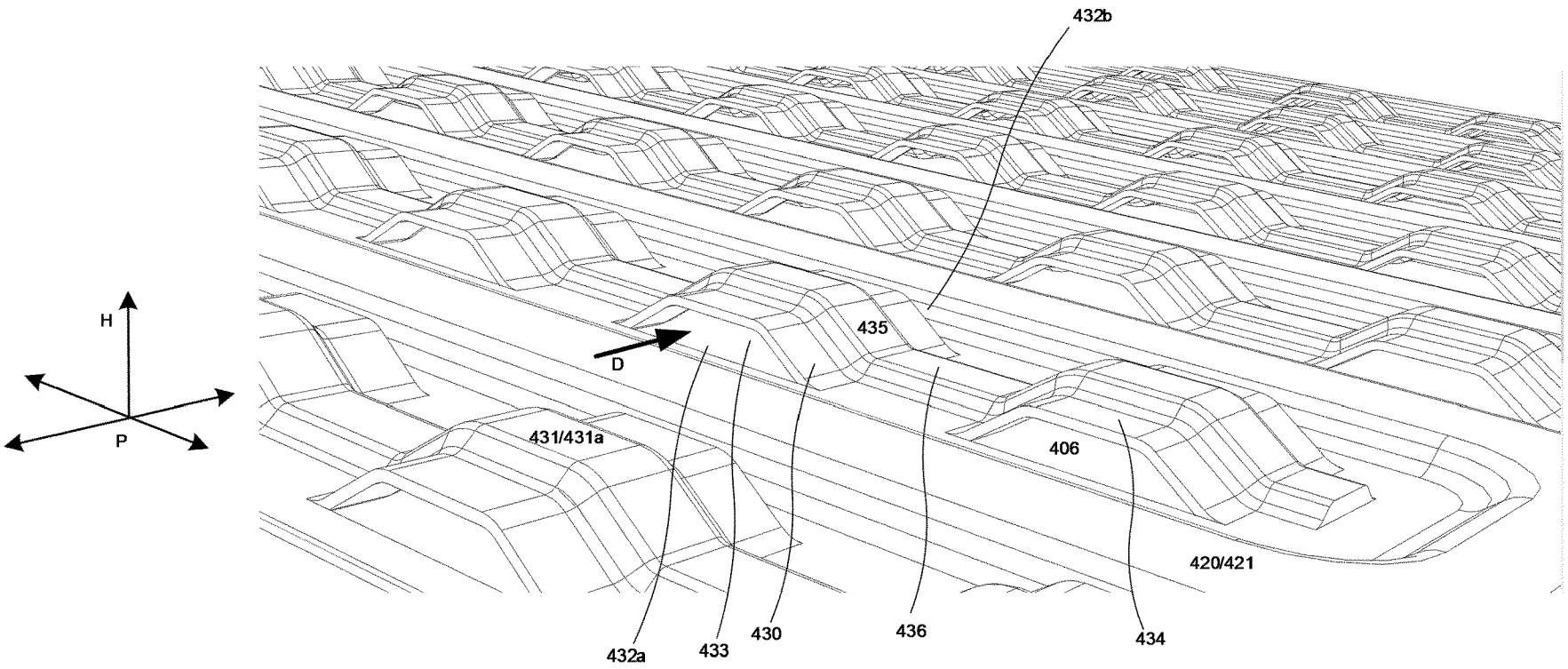
Figure 5A:
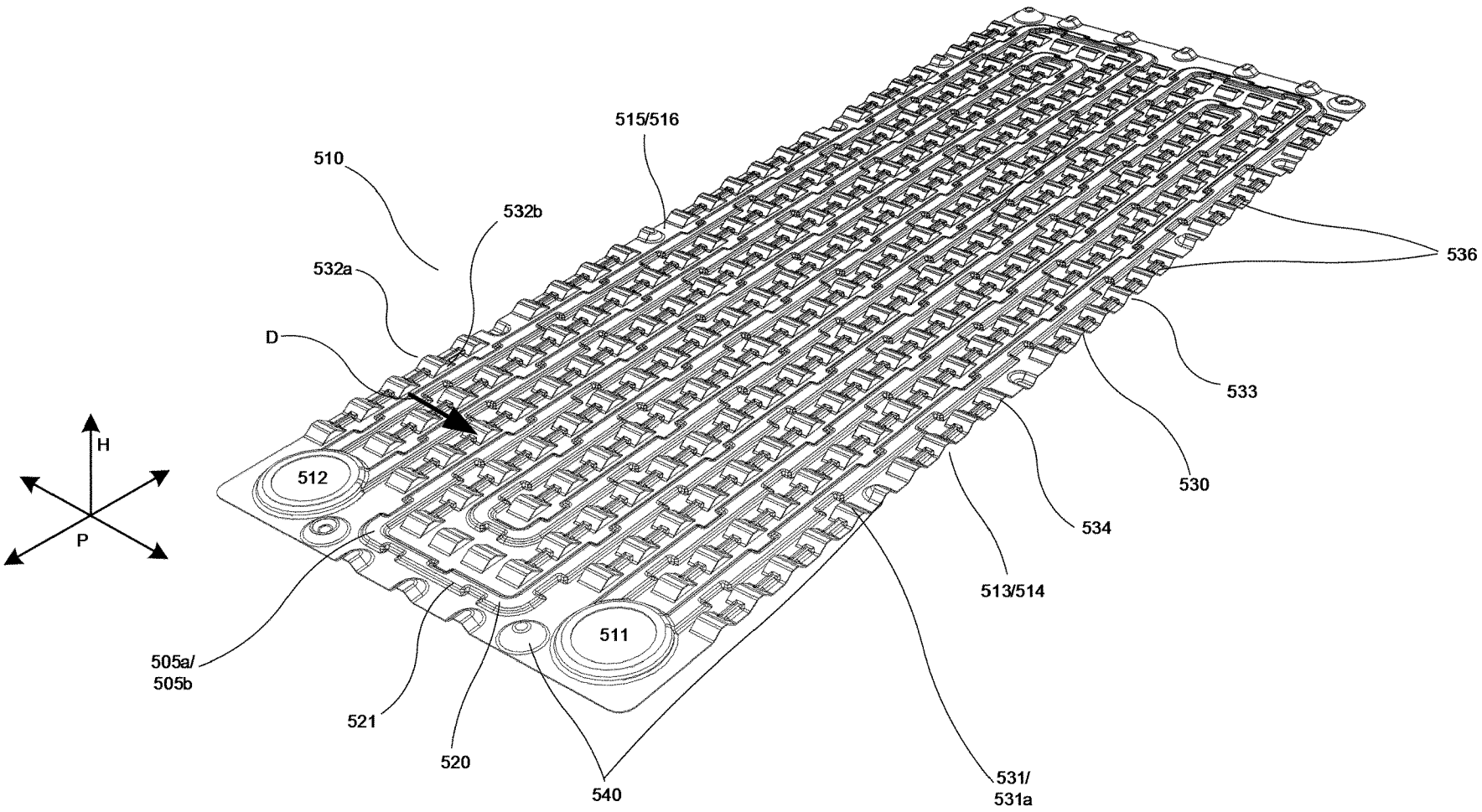
Figure 5B:
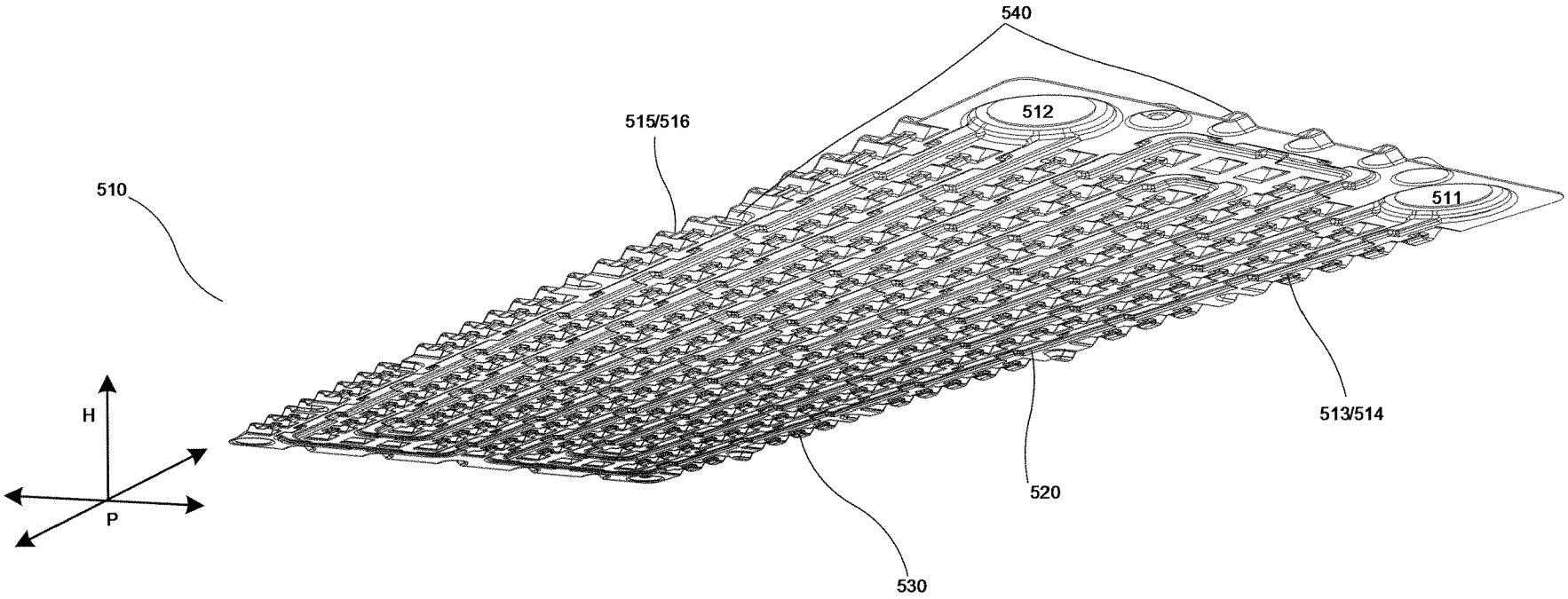
Figure 5C:
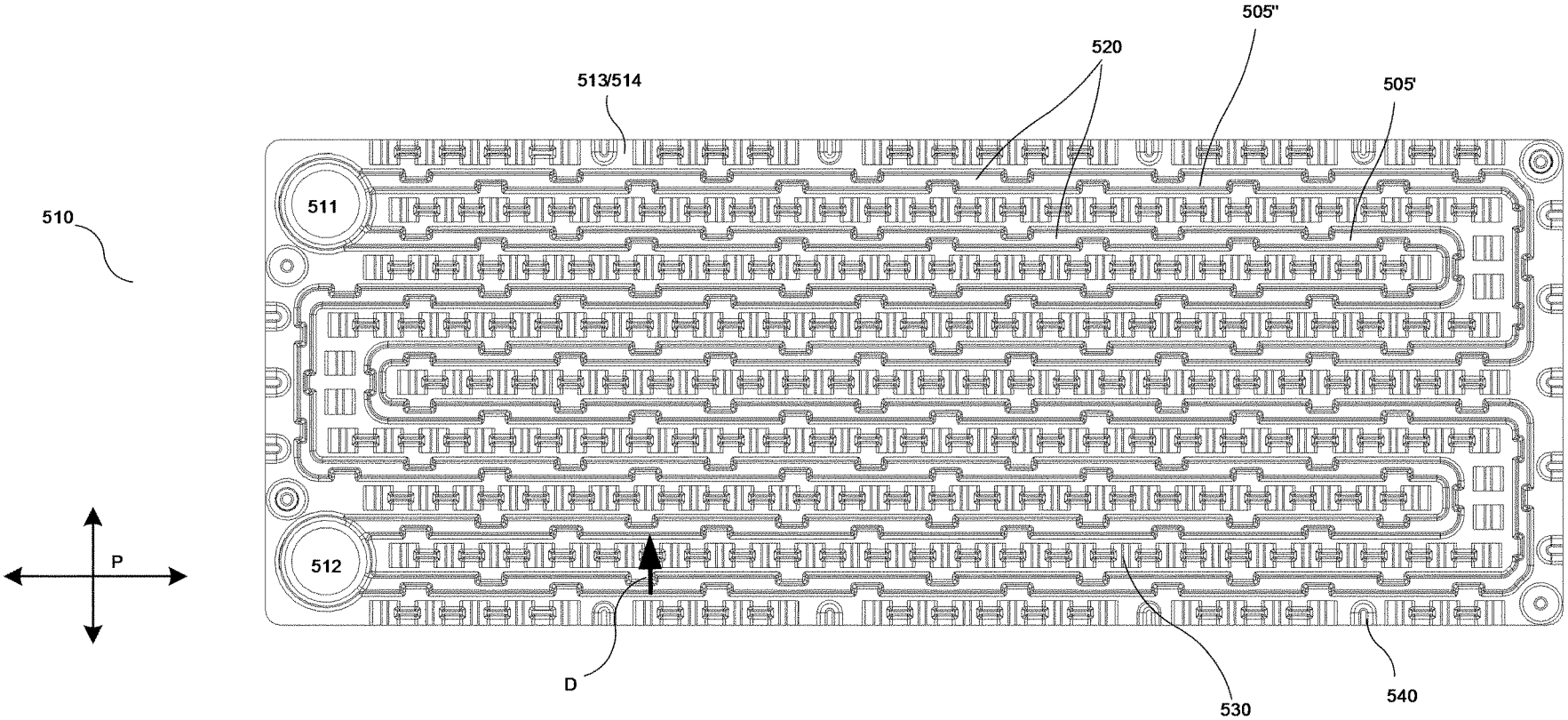
Figure 5D:
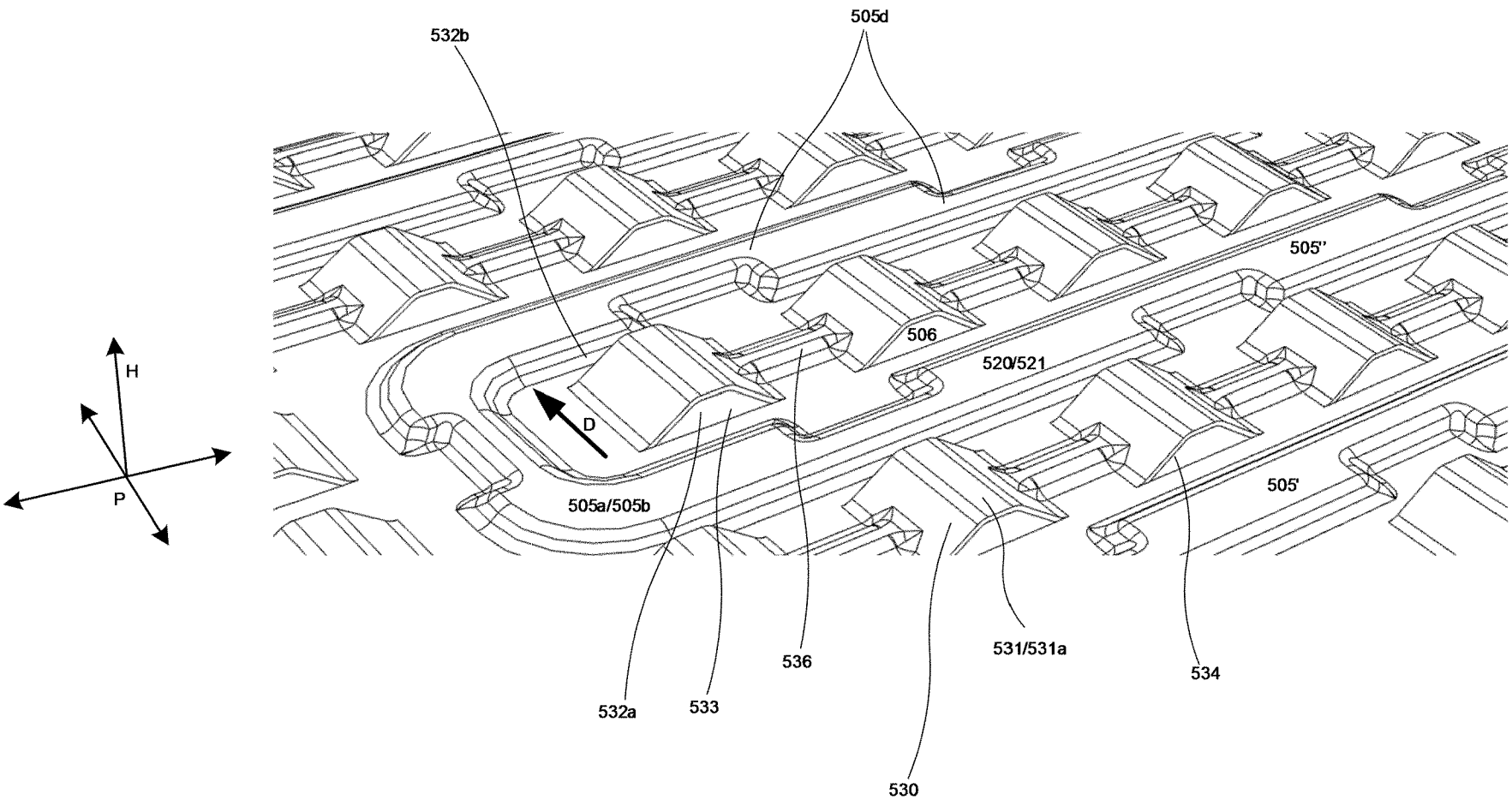
Figure 6A:
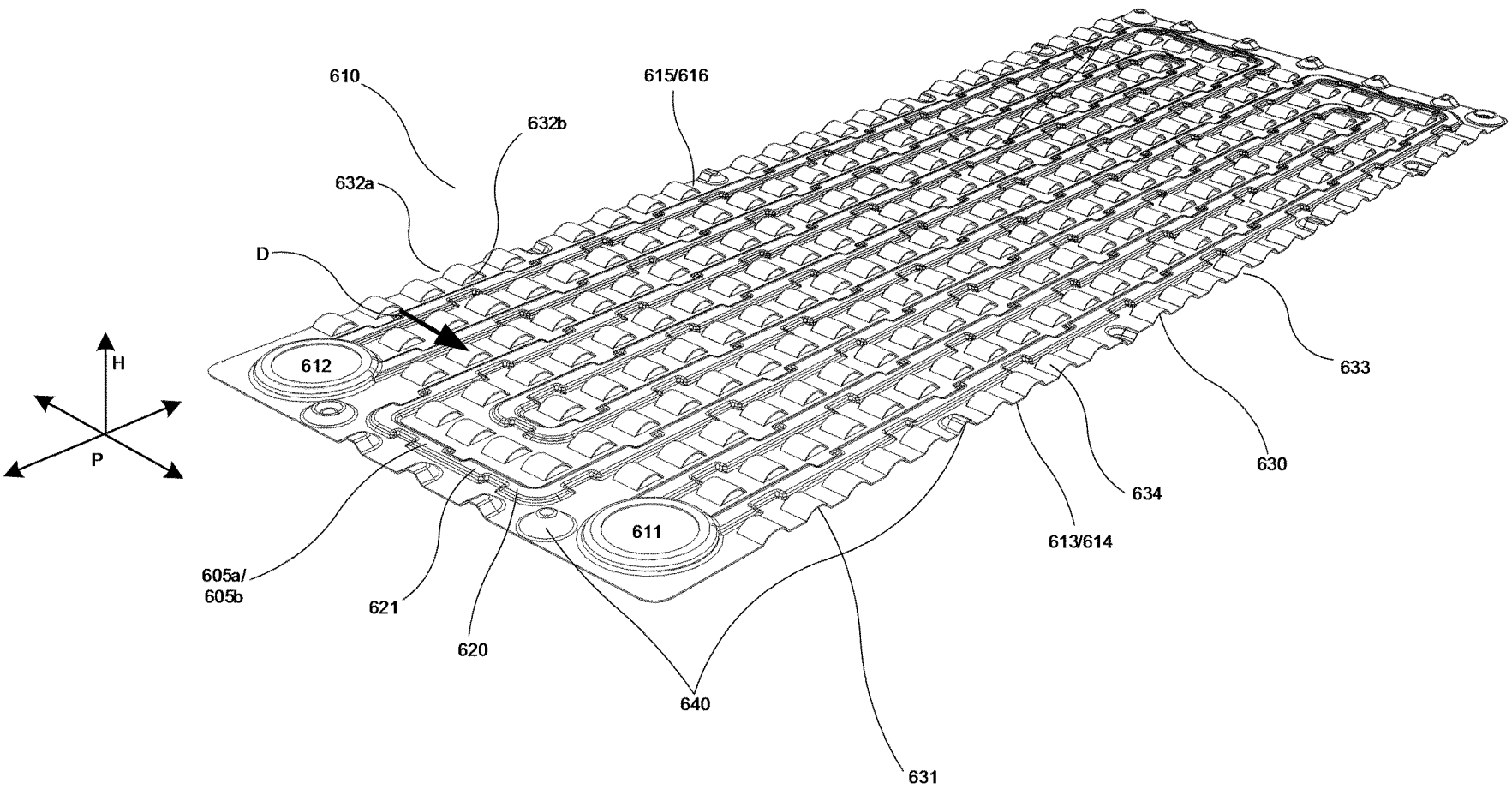
Figure 6B:
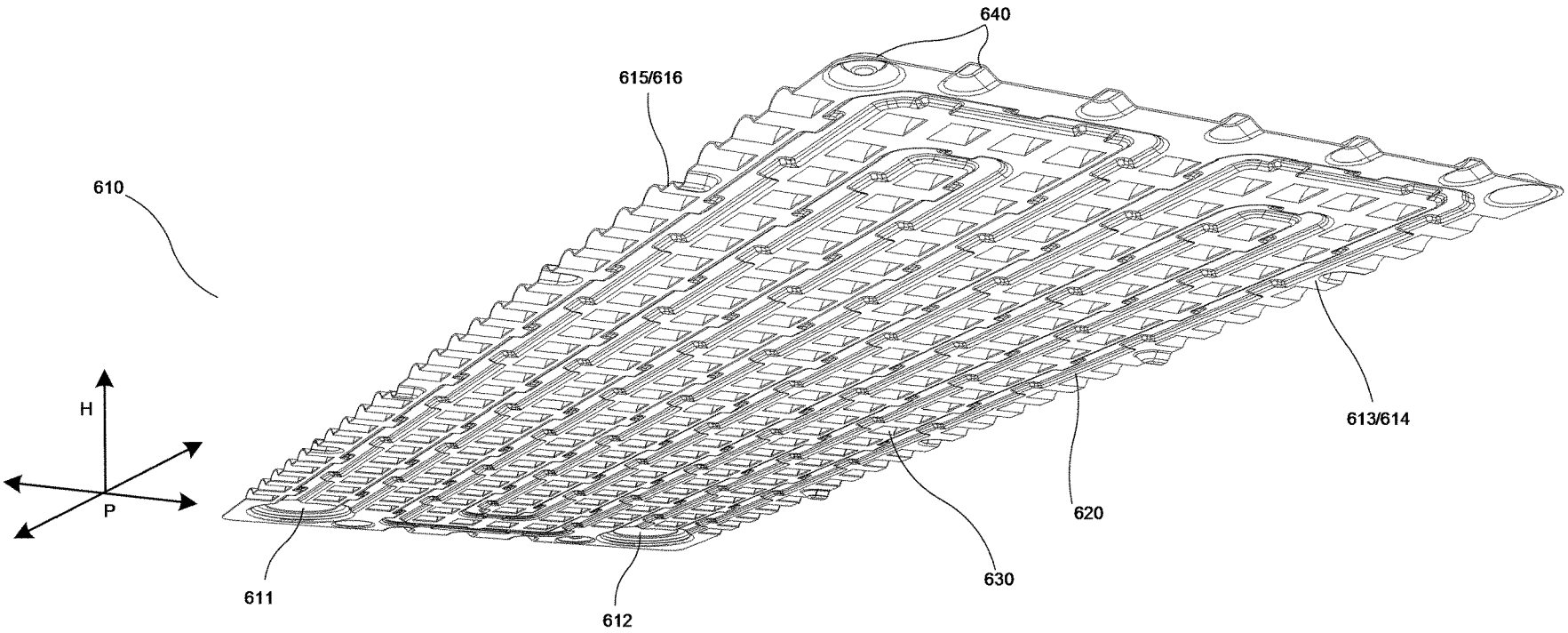
Figure 6C:
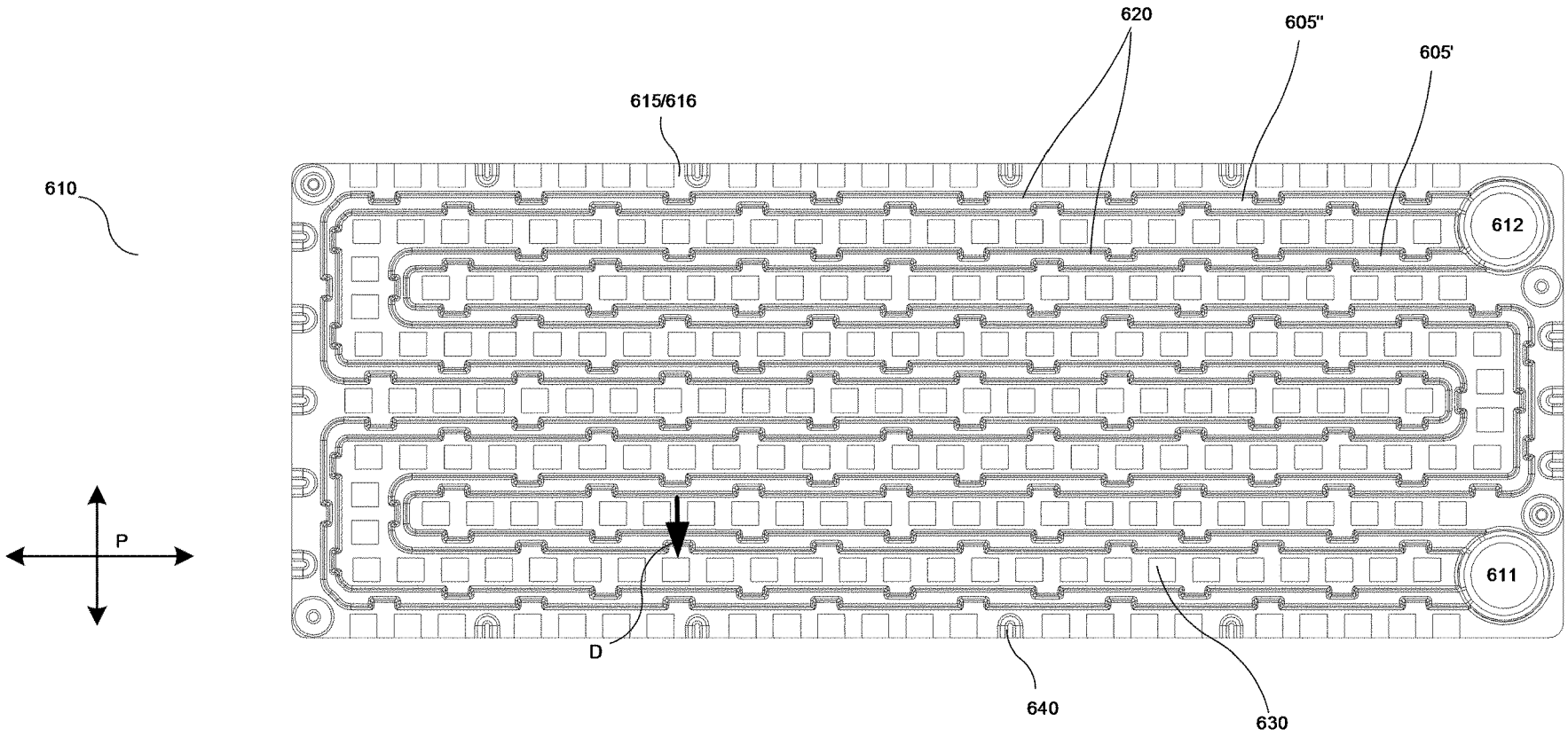

FIG. 2*a* is a perspective view of a second heat exchanging plate according to the invention, as seen from a top side of said second plate, showing a second surface of the second plate;

FIG. 2*b* is a perspective view showing the second plate from a bottom side, showing a first surface of the second plate;

FIG. 2*c* is a plan top view of the second plate;

FIG. 2*d* is a perspective view of a second heat exchanger according to the invention, comprising the second plate;

FIG. 2*e* is a perspective cross-sectional view of the second heat exchanger;

FIG. 3*a* is a perspective view of a third heat exchanging plate according to the invention, as seen from a top side of said third plate, showing a second surface of the third plate;

FIG. 3*b* is a perspective view showing the third plate from a bottom side, showing a first surface of the third plate;

FIG. 3*c* is a plan top view of the third plate;

FIG. 3*d* is a perspective view of a third heat exchanger according to the invention, comprising the third plate;

FIG. 4*a* is a perspective view of a fourth heat exchanging plate according to the invention, as seen from a top side of said fourth plate, showing a second surface of the fourth plate;

FIG. 4*b* is a perspective view showing the fourth plate from a bottom side, showing a first surface of the fourth plate;

FIG. 4*c* is a plan bottom view of the fourth plate;

FIGS. 4*d* and 4*e* are respective detail perspective views of the fourth plate;

FIG. 5*a* is a perspective view of a fifth heat exchanging plate according to the invention, as seen from a top side of said fifth plate, showing a second surface of the fifth plate;

FIG. 5*b* is a perspective view showing the fifth plate from a bottom side, showing a first surface of the fifth plate;

FIG. 5*c* is a plan bottom view of the fifth plate;

FIG. 5*d* is a detail perspective views of the fifth plate;

FIG. 6*a* is a perspective view of a sixth heat exchanging plate according to the invention, as seen from a top side of said sixth plate, showing a second surface of the sixth plate;

FIG. 6*b* is a perspective view showing the sixth plate from a top side, showing a first surface of the sixth plate;

FIG. 6*c* is a plan bottom view of the sixth plate; and

Figure 6D:
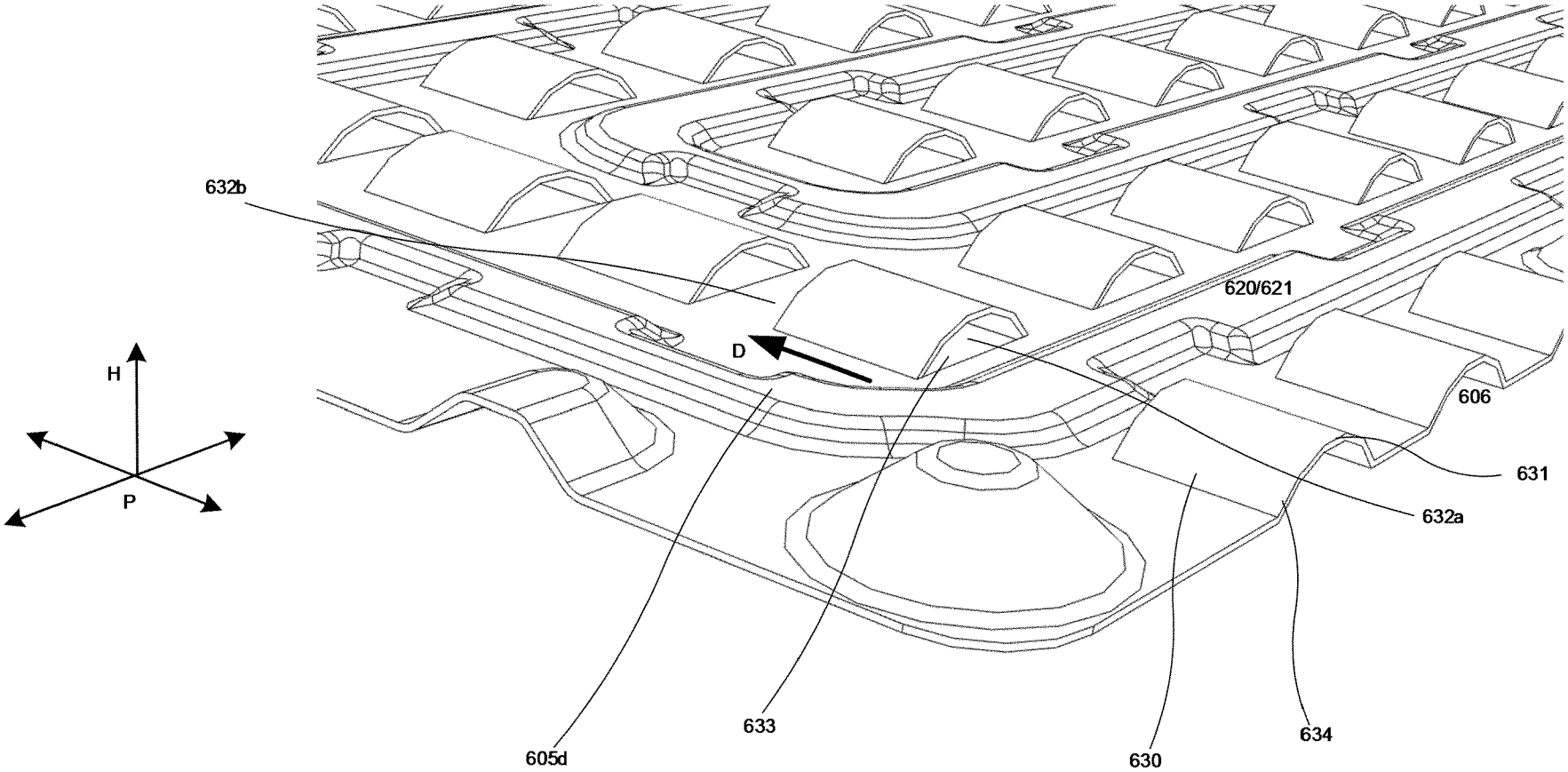

FIG. 6*d* is a detail perspective views of the sixth plate.

Across all reference numbers in all Figures, the same two last digits denote same or corresponding parts. In addition, all exemplifying embodiments illustrated in the Figures share the same three digit reference numbers for same parts.

Hence, in FIGS. 1*e*-1*k*; 2*d*; and 3*d*, a heat exchanger 100; 200; 300 according to a first aspect of the present invention is shown, which heat exchanger 100; 200; 300 is arranged for heat exchange between a first medium and a second medium.

The heat exchanger 100; 200; 300 comprises a main inlet 101; 201; 301 for the first medium and a main outlet 102; 202, 302 for the first medium.

The heat exchanger 100; 200; 300 also comprises a plurality of heat exchanging sheet metal plates 110; 210; 310. It is noted that such heat exchanging plates 410; 510; 610, suitable for use in such a heat exchanger, are also illustrated in FIGS. 4*a*-6*d*. FIGS. 1*a*-1*d*; 2*a*-2*c*; and 3*a*-3*c* also illustrate plates 110, 210, 310 in more detail.

The said plates 110; 210; 310; 410; 510; 610 are associated with a respective substantially parallel main plane P of extension and a height direction H perpendicular to said main plane P.

Moreover, each plate 110; 210; 310; 410; 510; 610 comprises a plate inlet 111; 211; 311; 411; 511; 611 for the first medium, which plate inlet is connected to the said main inlet 101; 201; 301 in question for the first medium. Similarly, each plate 110; 210; 310; 410; 510; 610 comprises a plate outlet 112; 212; 312; 412; 512; 612 for the first medium, connected to the said main outlet 102; 202; 302 for the first medium.

Also, each plate 110; 210; 310; 410; 510; 610 comprises a respective first heat transfer surface 114; 214; 314; 414; 514; 614 on a first side 113; 213; 313; 413; 513; 613 of the plate 110; 210; 310; 410; 510; 610 in question, arranged to be in contact with the first medium flowing along said first side 113; 213; 313; 413; 513; 613. Correspondingly, each plate 110; 210; 310; 410; 510; 610 comprises a respective second heat transfer surface 116; 216; 316; 416; 516; 616 on a second side 115; 215; 315; 415; 515; 615 of the plate 110; 210; 310; 410; 510; 610 in question, arranged to be in contact with the second medium flowing along said second side 115; 215; 315; 415; 515; 615. The first medium is hence arranged to flow along the first heat transfer surface 114; 214; 314; 414; 514; 614, with direct thermal contact therewith, while the second medium is arranged to flow along the second heat transfer surface 116; 216; 316; 416 516; 616, with direct thermal contact therewith.

In the exemplifying plates 110, 210, 310, 410, 510, 610 shown in the Figures, it is noted that the respective first medium is arranged not to contact the entire first heat transfer surface 114; 214; 314; 414; 514; 614 in question, since the first side 113; 213; 313; 413; 513; 613 of one plate is arranged to abut the respective first side 113; 213; 313; 413; 513; 613 of an adjacent plate in the plate stack. The parts of the respective first heat transfer surface 114; 214; 314; 414; 514; 614 arranged to contact the first medium are in fact those forming the first medium flow channels 105'-105"; 205'; 305'-305"; 405'-405"; 505'-505"; 605'-605". See below.

Hence, the first medium is arranged to enter the heat exchanger 100; 200; 300 via said main inlet 101; 201; 301; to thereafter be distributed, in a parallel flow fashion, to the respective inlet 111; 211; 311; 411; 511; 611 of each plate 110; 210; 310; 410; 510; 610 comprised in the heat exchanger 100; 200; 300; to flow along said first heat transfer surface 114; 214; 314; 414; 514; 614; to exit via the respective plate outlet 112; 212; 312; 412; 512; 612 for the first medium; to be collected, in a parallel flow fashion, and exit as one single flow through the heat exchanger main outlet 102; 202, 302 for the first medium. During such flow, the first medium is in general heat exchanged to the second medium via the sheet metal material of each plate 110; 210; 310; 410; 510; 610, between the first 113; 213; 313; 413; 513; 613 and second 115; 215; 315; 415; 515; 615 sides, and in particular between the first 114, 214, 314, 414, 514, 614 and second 116, 216, 316, 416, 516, 616 heat transfer surfaces. At the bridge-shaped indentations 130, 230, 330, 430, 530, 630 described below, the second medium will directly contact both sides of the plate in question, resulting in that these structures locally accumulate or disseminate thermal energy, and that such energy is led to other parts of the same plate, resulting in the said heat exchange.

Preferably, the first and second medium never come into direct contact with each other during their respective flows through the heat exchanger 100; 200; 300. Hence, the heat exchanger 100; 200; 300 preferably further comprises a respective main inlet and a respective main outlet for the second medium, arranged so as to keep the first and second media separated throughout the respective flows through the heat exchanger 100; 200; 300.

According to the first aspect of the present invention, each plate 110; 210; 310; 410; 510; 610 comprises a respective plurality of indentations 120, 130, 140; 220, 230, 240; 320, 330, 340; 420, 430, 440; 520, 530, 540; 620, 630, 640 in the plate in question, formed by the sheet metal of the plate in question bulging out locally in the said plate height direction H. it is noted that the height "direction" may refer to either of the two opposite directions along the height direction H vector as illustrated in the Figures. Various types of such indentations will be exemplified below. It is specifically noted that an "indentation", as the term is used herein, means any departure from the main plane P of extension of the plate in question in the height direction H. Hence, the plate in question may bulge out in either height direction H from the main plane P. If not stated otherwise, it is preferred that such indentations do not comprise, and are not formed by the creation of, through holes through the metal sheet material.

However, at least each one of the bridge-shaped indentations 130; 230; 330; 430; 530; 630 described below do comprise such a through hole.

Further according to the first aspect of the invention, the plates 110; 210; 310; 410; 510; 610 are fastened, preferably permanently fastened, preferably brazed, together in a stack on top of each other, with their respective main planes P substantially parallelly arranged. Also, there are at least two different types of plates, where the stack comprises plates of a first type 104*a*; 204*a*; 304*a* and plates of a second type 104*b*; 204*b*; 304*b* that are arranged alternatingly in said stack. Preferably, the said plates of said first type 104*a*; 204*a*; 304*a* are preferably identical among them, and the said plates of said second type 104*b*; 204*b*; 304*b* are also preferably identical among them. Further, the plates of the first type 104*a*; 204*a*; 304*a* preferably have a shape which is a mirror image of a corresponding shape of the plates of the second type 104*b*; 204*b*; 304*b*. In addition or alternatively, the plates of the first type 104*a*; 204*a*; 304*a* and the plates of the second type 104*b*; 204*b*; 304*b* all have identical shape, but the plates of the first type 104*a*; 204*a*; 304*a* are arranged with 180° rotation, in the main plane P, as compared to the plates of the second type 104*b*; 204*b*; 304*b* in said stack. The exemplifying plates 110, 210, 310, 410, 510, 610 shown in the Figures are in fact all examples of such identical but rotated plate pair plates. It is, however, realized that the first and second type plates may be non-identical also.

It is realized that, even though the stack comprises only plates of said first 104*a*; 204*a*; 304*a* and second 104*b*; 204*b*; 304*b* types, apart possibly for any stack start and end plates, the stack may also in some embodiments comprise other plate types. For instance, there may also be plates of a third and a fourth type, that are arranged pairwise in the stack. There may also be additional plates such as substantially flat but perforated plates arranged between pairs of first and second type plates. It is preferred that, in all cases, the second medium can flow freely throughout the whole heat exchanger, via the through-holes in the bridge-shaped indentations as described herein.

That the plates are arranged with their respective main planes arranged "substantially in parallel" with each other means that the plates are arranged one on top of the other in a pile, the height of which pile is in general perpendicular to the main planes in question, but where individual plates may be slightly angled in relation to each other so as not to achieve a fully parallel orientation with respect to each other, for instance due to varying indentations heights across plates. It is preferred, however, that the main planes of the plates are arranged fully in parallel.

The plates 110; 210; 310; 410; 510; 610 may be arranged with a respective bent edge (not shown in the Figures), in order to improve stability of the said stack. In this case, all plates are preferably arranged with their respective bent edge projecting in the same height direction H in the stack, irrespectively of the type of the plate in question. Hence, in the case of such bent edges, the above said mirror shape and/or 180° rotation pertain irrespectively of any bent edge.

The stack may furthermore also comprise suitable start- and end plates.

The plate 110; 210; 310; 410; 510; 610 is manufactured from sheet metal, preferably with a material thickness which is substantially equal across the whole plate main plane P, and in particular across all indentations 120, 130, 140; 220, 230, 240; 320, 330, 340; 420, 430, 440; 520, 530, 540; 620, 630, 640. Advantageously, the plate 110; 210; 310; 410; 510; 610 is manufactured from a piece of sheet metal which is stamped into the desired shape.

Importantly, in the stack, the plates 110; 210; 310; 410; 510; 610 are arranged in relation to each other so that corresponding ones of said indentations 120, 130, 140; 220, 230, 240; 320, 330, 340; 420, 430, 440; 520, 530, 540; 620, 630, 640 of adjacent plates in the stack are arranged in direct contact with each other, so that at least one of corresponding first 114; 214; 314; 414; 514; 614 and second 116; 216; 316; 416; 516; 616 surfaces of adjacent plates abut each other via said indentations and so that at least one flow channel 105'405"; 205'; 305'-305"; 405'-405"; 505'-505"; 605'-605" for said first medium and at least one flow channel 106; 206; 306; 406; 506; 606 for said second medium are formed between said surfaces. It is noted that, although the respective flow channels 106; 206; 306; 406; 506; 606 for said second medium are indicated in the Figures at specific points, in the exemplifying embodiments of the invention illustrated in the Figures, the flow channels 106; 206; 306; 406; 506; 606 for said second medium occupy substantially the whole stack save for the sheet metal material and the closed flow channels 105'-105"; 205'; 305'-305"; 405'-405"; 505'-505"; 605'-605" for the first medium. See below.

This way, due to the fastened together arrangement, preferably brazed together arrangement, with indentation abuttal between plates, the stack preferably forms a self-supporting structure with space between individual plates, allowing first and second media to flow through the structure. The brazing is preferably performed by placing a sheet of brazing material between every other plate in the stack and heating the resulting stack to a temperature at which the brazing material melts and provides adhesion between adjacent plates. In the preferred case in which the plate 110, 210, 310, 410, 510, 610 material is aluminium, however, brazing is preferably achieved with the plate aluminium itself as the brazing material, such as by providing a brazing alloy cladding on the aluminium plate surfaces before brazing.

It is realized that the plates 410; 510; 610 illustrated in FIGS. 4*a*-6*d* can be assembled in a respective stack corresponding to the one illustrated in FIGS. 1*j*-1*k*.

It is further realized that, in all heat exchangers and stacks illustrated in the Figures, there are only four plates, for reasons of simplicity. However, in practical applications, it is preferred to use at least 20 plates, i.e. at least 10 pairs of a respective plate of a first type and a respective plate of a second type. Further, it is preferred that each stack comprises at the most 400 plates.

According to the first aspect of the invention, each plate of the first type 104*a*; 204*a*; 304*a* comprises a respective ridge-shaped indentation 120; 220; 320; 420; 520; 620. As used herein, the term "ridge-shaped indentation" is an indentation as defined above, having an overall shape which is elongated in the respective main plane P, hence forming a "ridge" along the main plane P of the plate in question. According to the first aspect of the invention, said ridge-shaped indentation 120; 320; 420; 520; 620 of said plate of the first type 104*a*; 204*a*; 304*a* is arranged to form, together with a corresponding ridge-shaped indentation of an adjacent plate of the second type 104*b*; 204*b*; 304*b*, at least one closed flow channel 105'-105"; 205'; 305'-305"; 405'-405"; 505'-505"; 605'-605" for the first medium from the first medium plate inlet 111; 211; 311; 411; 511; 611 to the first medium plate outlet 112; 212; 312; 412; 512; 612 of the plate in question. That the ridge-shaped indentation 120; 220; 320; 420; 520; 620 "forms" the closed flow channel in question is intended to mean that it at least forms part of a structure defining the flow channel. Hence, the flow channel may be defined also by other structural features of the heat exchanger 100; 200; 300. What is important is that each such closed flow channel 105'-105"; 205'; 305'-305"; 405'-405"; 505'-505"; 605'-605" is "closed", in the sense that it is arranged to convey first medium from said plate inlet 111; 211; 311; 411; 511; 611 to said outlet 112; 212; 312; 412; 512; 612, and that this conveying takes place without the conveyed first medium mixing with the second medium at any point. The said ridge-shaped indentations 120; 220; 320; 420; 520; 620 are specifically arranged so as to provide the closed shape of said channels.

Further according to the first aspect of the invention, each plate of the first type 104*a*; 204*a*; 304*a* comprises a respective bridge-shaped indentation 130; 230; 330; 430; 530; 630, formed to comprise at least one respective through hole 132*a*, 132*b*; 232*a*, 232*b*; 332*a*, 332*b*; 432*a*, 432*b*; 532*a*, 532*b*; 632*a*, 632*b* through the metal sheet of the plate in question.

As used herein, a "bridge-shaped indentation" is an indentation as defined above, but comprising a bridge-shaped part or detail, and hence comprising at least one such through hole in the said sheet metal.

It is realized that, apart from being "ridge-shaped" or "bridge-shaped", the indentations 120, 130; 220, 230; 320, 330; 420, 430; 520, 530; 620, 630 may have any suitable form and shape. For instance, they may have a quadratic, semi-circular or stepwise linear profile shape. This also applies to the additional indentations 140; 240; 340; 440; 540; 640 discussed below.

Moreover according to the first aspect of the invention, the said bridge-shaped indentation of each plate of the first type 104*a*; 204*a*; 304*a* is arranged to form, together with a corresponding bridge-shaped indentation of an adjacent plate of the second type 104*b*; 204*b*; 304*b*, an open flow channel 106; 206; 306; 406; 506; 606 for the second medium. Said open flow channel 106; 206; 306; 406; 506; 606 communicates with corresponding open flow channels between other pairs of first 104*a*; 204*a*; 304*a* and second 104*b*; 204*b*; 304*b* type plates in the said stack.

Specifically, the heat exchanging plates 110; 210; 310; 410; 510; 610 are arranged to form such flow channels 105'-105"; 205'; 305'-305"; 405'-405"; 505'-505"; 605'-605"; 106; 206; 306; 406; 506; 606 when being fastened/brazed together in a stack as described above.

It has turned out that such a heat exchanger 100, 200; 300 achieves the above described objectives. Specifically, such a heat exchanger provides for very good mechanical stability while offering very good thermal heat exchanging efficiency and high throughput, in particular in the preferred case in which the first medium is a liquid or a gas, and the second medium is a gas.

It is understood that the corresponding is true with respect to the individual heat exchanging plates 110; 210; 310; 410; 510; 610, since they can be fastened/brazed together to form stacks as described above, in turn achieving said objectives.

As illustrated in the Figures, the above described principles can be implemented in different ways, of which the Figures illustrate six different ones, that will be described in detail in the following. Since many of the features are shared among several examples, and since the Figures share the same reference numeral last two digits for corresponding or identical parts, all individual details of all shown examples are not described explicitly herein. Hence, what is said regarding one heat exchanger or one plate is generally applicable also to other heat exchangers or plates, when there are no incompatibilities and unless otherwise stated.

According to a preferred embodiment, a maximum height, as measured in the said height direction H, of said ridge-shaped indentations 120; 220; 320; 420; 520; 620 is lower than a corresponding maximum height of the bridge-shaped indentations 130; 230; 330; 430; 530; 630. In particular, it is preferred that a plurality, preferably a majority, of the ridge-shaped indentations 120; 220; 320; 420; 520; 620 are of substantially the same height, and that a plurality, preferably a majority, of the bridge-shaped indentations 130; 230; 330; 430; 530; 630 are also of substantially the same height among them, which is larger than said height for said plurality of ridge-shaped indentations. Then, it is preferred that each plate of the first type 104*a*; 204*a*; 304*a* is fastened/brazed to a respective plate of the second type 104*b*; 204*b*; 304*b* via at least a plurality of contact points between respective crest points of the bridge-shaped indentations. This crest point may be a crest point of a reinforcement ridge such as the one of the types described herein. It is noted that there may also be additional fastened/brazed together contact points, such as at the first medium inlets 111, 211, 311, 411, 511, 611 and outlets 112, 212, 312, 412, 512, 612, and as well additional dimples 140, 240, 340, 440, 540, 640.

In other words, in such a configuration, the ridge-shaped indentations 120; 220; 320; 420; 520; 620 will form closed flow channels 105'-105"; 205'; 305'-305"; 405'-405"; 505'-505"; 605'-605" for the first medium that are spaced from each other between adjacent plates not sharing the same such flow channel 105'-105"; 205'; 305'-305"; 405'-405"; 505'-505"; 605'-605". The said space between flow channels for the first medium then preferably constitute part of said flow channels 106; 206; 306; 406; 506; 606 for the second medium, flowing between said flow channels 105'-105"; 205'; 305'-305"; 405'-405"; 505'-505"; 605'-605" for the first medium.

In a particularly preferred embodiment, a plurality, preferably a majority, preferably all, of the ridge-shaped indentations 120; 220; 320; 420; 520; 620 bulge out on the same side of the main plane P as a plurality of the bridge-shaped indentations 130; 230; 330; 430; 530; 630. In this case, it is further preferred that, for a respective crest point 121; 221; 321; 421; 521; 621 of the ridge-shaped indentations 120; 220; 320; 420; 520; 620 of plates of the first type 104*a*; 204*a*; 304*a*, preferably for all such crest points, the crest point in question does not come into direct contact with any crest points of corresponding ridge-shaped indentations of plates of the second type 104*b*; 204*b*; 304*b*.

One important case in which not all of the out-bulging of the ridge-shaped indentations 120; 220; 320; 420; 520; 620 may project in the same direction as the bridge-shaped indentations 130; 230; 330; 430; 530; 630 is when the closed flow channels 105'-105"; 205'; 305'-305"; 405'-405"; 505'-505"; 605'-605" comprise steps 105*c*; 205*c*; 305*c* as described below and as shown in the Figures in relation to heat exchangers 100, 200 and 300. In this and in other cases, a first ridge-shaped indentation may locally bulge out in a height H direction opposite to the bulging direction, from the main plane P, of the bridge-shaped indentations 130; 230; 330; 430; 530; 630 of the plate in question, at locations where a second ridge-shaped indentation of an adjacent plate, corresponding to the said first ridge-shaped indentation, bulges in the same direction as the first ridge-shaped indentations. Hence, in these cases, the first and second ridge-shaped indentations together form a closed first medium flow channel 105'-105"; 205'; 305'-305", arranged between adjacent plates.

More particularly, it is preferred that each plate 110; 210; 310; 410; 510; 610 comprises a non-indented part, which is arranged to abut a corresponding non-indented part of an adjacent plate in said stack. This can, for instance, be achieved by all indentations 120, 130, 140; 220, 230, 240;

320, 330, 340; 420, 430, 440; 520, 530, 540; 620, 630, 640 bulging out only in one and the same direction across the whole plate 110; 210; 310; 410; 510; 610 in question, leaving the side facing the other way without, or substantially without, any protrusions from said main plane P, and therefore suitable for direct abuttal with an adjacent plate main plane against main plane. As described above, such a side may be arranged with ridge-shaped indentation that locally bulge out, in cases where a ridge-shaped indentation of an adjacent plate in the stack locally bulge in the same direction. That the side is "substantially without" protrusions is intended to encompass this situation.

Then, each plate of the first type 104*a*; 204*a*; 304*a* may preferably be fastened/brazed together with an adjacent plate of the second type 104*b*; 204*b*; 304*b* by abuttal of such a non-indented or substantially non-indented part of the first plate first heat transfer surface 114, 214, 314 to a corresponding non-indented or substantially non-indented part of the second plate first heat transfer surface 114, 214, 314. This way, a very robust construction is achieved, which also provides for very good thermal transfer between the first and second media.

As is best illustrated in FIGS. 1*a*, 1*k*, 2*a*, 3*a*, 4*a*, 4*d*, 4*e*, 5*a*, 5*d*, 6*a* and 6*d*, in a preferred embodiment at least one of the said bridge-shaped indentations 130; 230; 330; 430; 530; 630, preferably a plurality, more preferably substantially all, of the said bridge-shaped indentations comprise two through holes 132*a*, 132*b*; 232*a*, 232*b*; 332*a*, 332*b*; 432*a*, 432*b*; 532*a*, 532*b*; 632*a*, 632*b* in the metal sheet in question, as well as a bridge part 134; 234; 334; 434; 534; 634 forming a passage between the said through holes. Further preferably, the passage hence formed has a general direction being substantially parallel to a general flow direction D of the second medium past the bridge-shaped indentation 130; 230; 330; 430; 530; 630 in question. In other words, the second medium preferably flows, locally, in a general direction D which is such that the second medium will be able to pass through the said passage without substantially changing its general flow direction as a result. This is illustrated in the Figures. The "general flow direction" is preferably a local general flow direction, in the direct vicinity of the bridge-shaped indentation 130; 230; 330; 430; 530; 630 in question, so that the flow direction of the second medium, as seen in the main plane P, is substantially unaffected by the bridge-shaped indentation and the passage in particular. However, it is preferred that a plurality, preferably all, of the bridge-shaped indentations 130; 230; 330; 430; 530; 630 are arranged with their respective passages arranged rotationally aligned in relation to each other, with substantially parallel flow-through directions, so that the local general flow direction, as seen in the main plane P, of the second medium is the same across a larger connected part of the second heat transfer surface 116; 216; 316; 416; 516; 616 in question. Such configuration results in low second medium pressure drop. At any rate, the second medium may move in the height direction H across the heat exchanger 100, 200 300.

Furthermore, it is preferred that, for a plurality, preferably substantially all, of the bridge-shaped indentations 130; 230; 330; 430; 530; 630, a corresponding bridge-shaped indentation of an adjacent plate, the two bridge-shaped indentations of said two plates are arranged so that the second medium can flow freely in through a first through hole 132*a*; 232*a*; 332*a*; 432*a*; 532*a*; 632*a* of one of said two plates and then out through a second through hole 132*b*; 232*b*; 332*b*; 432*b*; 532*b*; 632*b* of the other one of said two plates, and as a result pass from one second medium flow channel 106; 206; 306; 406; 506; 606 between a first pair of plates to a different second medium flow channel between a second pair of plates. Preferably, such passing between second medium flow channels comprises passing past a first medium flow channel 105'-105"; 205'; 305'-305"; 405'-405"; 505'-505"; 605'-605" in said height direction H. Preferably, the second medium is allowed to freely pass between at least three, preferably all, second medium channels 106; 206; 306; 406; 506; 606, through corresponding passages of bridge-shaped indentations 130; 230; 330; 430; 530; 630. This provides for an open yet robust structure allowing the second medium to be heat exchanged with the first medium in an efficient manner see, for instance, FIG. 1*h*.

Preferably, respective passages of said type, formed by respective bridge-shaped indentations 130; 230; 330; 430; 530; 630 arranged after one another in the said general flow direction D, are offset in a direction in said main plane P which is perpendicular to said general flow direction D, so that passages adjacently arranged in said general flow direction D are not linearly aligned in said perpendicular direction and along the flow direction D. In other words, the bridge-shaped indentations 130, 230, 330, 430, 530, 630 are staggered along the general flow direction D. This is illustrated, inter alia, in FIG. 1*i*.

According to a preferred embodiment, the said local general flow direction D is substantially perpendicular to a local general direction of an adjacent closed flow channel 105'-105"; 205'; 305'-305"; 405'-405"; 505'-505"; 605'-605" for the first medium arranged adjacent to the said bridge-shaped indentation 130; 230; 330; 430; 530; 630 in question. See FIGS. 1*c*, 2*c*, 3*c*, 4*c*, 5*c* and 6*c*. This results in high thermal heat exchanging efficiency, in particular in the preferred case that the second medium passes several first medium closed flow channels on its way through the heat exchanger. This is, for instance, illustrated in FIGS. 2*c* and 3*c*, where the general flow direction D for the second medium is substantially the same across the whole plate 210, 310 in question. Preferably, as is illustrated in the Figures, several bridge-shaped indentations 130; 230; 330; 430; 530; 630 are linearly aligned along one and the same first medium flow channel 105'-105"; 205'; 305'-305"; 405'-405"; 505'-505"; 605'-605" and arranged with respective local flow directions D (preferably substantially identical flow directions D) arranged so that the second medium flows past the first medium flow channel 105'-105"; 205'; 305'-305"; 405'-405"; 505'-505"; 605'-605" via the bridge-shaped indentations 130; 230; 330; 430; 530; 630, preferably substantially perpendicularly to the first medium flow channel in question.

As is illustrated best in FIGS. 1*k*, 2*a*, 3*a*, 4*d* and 5*d*, a respective bridge-shaped indentation crest point 131; 231; 331; 431; 531; 631 is in the form of a locally flat surface 131*a*; 231*a*; 331*a*; 431*a*; 531*aa* forming the attachment point between two abutting such respective crest points of adjacently arranged plate pairs 104*a*, 104*b*; 204*a*, 204*b*; 304*a*, 304*b* in the stack. This provides for a robust construction without deteriorating thermal performance.

As illustrated in FIG. 6*d*, the said bridge-shaped indentation 630 has a smoothly curved convex shape, preferably a substantially parabolic or semi-circular shape. The two different shapes can be combined, by arranging a locally flat crest point surface to a curved convex shaped bridge-shaped indentation.

In general, all which is said herein regarding individual bridge-shaped indentations 130; 230; 330; 430; 530; 630 is applicable to a plurality, preferably substantially all, of the bridge-shaped indentations of the plate 110; 210; 310; 410; 510; 610 in question. All which is said regarding individual ridge-shaped indentations 120; 220; 320; 420; 520; 620 is in general applicable to all ridge-shaped indentations of the plate in question. All which is said regarding individual plates 110; 210; 310; 410; 510; 610 is applicable to all or substantially all plates in the heat exchanger 100; 200; 300.

As is best illustrated in FIGS. 3*a*, 4*e* and 5*d*, the plates 310; 410; 510 preferably comprise ridge-shaped first reinforcement indentations 336; 436; 536 running between adjacent bridge-shaped indentations 330; 430; 530, connecting different adjacently arranged ones of said bridge-shaped indentations 330; 430; 530.

Similarly, as is illustrated in FIGS. 4*d* and 4*e*, the bridge-shaped indentations themselves comprise ridge-shaped second reinforcement indentations 435 running across the bridge-shaped indentation in question, from a first side of the bridge-shaped indentation 330; 430; 530 to an opposite second side of the bridge-shaped indentation in question. Preferably, each of said first and second reinforcement indentations 336; 435, 436; 536 has a respective main longitudinal ridge direction which is substantially perpendicular, in the main plane P in question, to the said general flow direction D.

According to a preferred embodiment, at least one, preferably the majority, preferably all, of said reinforcement ridge-shaped indentations 435 running across a respective bridge-shaped indentation 430 bulges in the height direction H in the same direction as compared to the bridge-shaped indentation 430 in question. Herein, "in the same height direction H" means parallel to the height direction, and in the same absolute direction in relation to the main plane P. Hence, the reinforcement indentation forms an additional bump on top of the bridge-shaped indentation 430 on which it sits. This is illustrated in the Figures, and provides good stability and in particular in case the reinforcement ridge-shaped indentations 435 are used as fastening points for an adjacent arranged plate.

However, alternatively, at least one, preferably the majority, preferably all, of said reinforcement ridge-shaped indentations 435 running across a respective bridge-shaped indentation 430 bulges in the height direction H in the opposite direction as compared to the bridge-shaped indentation 430 in question, other words in parallel to the height direction H but in the opposite absolute direction in relation to the main plane P. Hence, the reinforcement indentation 435 in this case forms an indentation into the bridge-shaped indentation 430 across which it sits. This provides for a decreased pressure drop for the second medium.

These two alternative embodiments can also be combined as is suitable, wherein at least some reinforcement ridge-shaped indentations 435 of one and the same plate 410 bulge in a first height H direction, while others bulge in the opposite height H direction.

Preferably, the reinforcement ridges 336; 435, 436; 536 are between 0.5 and 10 mm wide, along the main plane P, and between 0.1 and 2 mm high, in the height direction H. They are preferably substantially of equal height along their respective lengths.

According to one preferred embodiment, the first 336; 436; 536 and second 435 ridge-shaped reinforcement indentations with respect to (comprised as a part of) each bridge-shaped indentation 330; 430; 530 are connected, forming a connected ridge-shaped reinforcement indentation running both between and across bridge-shaped indentations, for several adjacently arranged bridge-shaped indentations. This third aspect of the invention is best illustrated in FIG. 4*e*, and provides a very robust yet simple and efficient construction.

Specifically, according to a preferred embodiment, the bridge-shaped indentations 430 comprise a reinforcement ridge-shaped indentation 436 running between and across at least two of the bridge-shaped indentations 430, connecting the said at least two bridge-shaped indentations 430 with each other. Further preferably, the bridge-shaped indentations 430 also comprise at least one, preferably several, reinforcement ridge-shaped indentation 436 running across at least one of the bridge-shaped indentations 430. Preferably at least a majority of the bridge-shaped indentations 430 have such reinforcement indentations 436 running across them. Further preferably, the said ridge-shaped reinforcement ridges 435, 436 are arranged to together form a connected reinforcement indentation across the plate 410.

Further illustrated in FIG. 4*e*, in a preferred embodiment the second ridge-shaped reinforcement indentations 435 have a respective crest point which is the point arranged furthest out from the main plane P in the height direction H of all indentations on the plate. In other words, the second ridge-shaped reinforcement indentation 435 is used to fasten the plate 310; 410; 510 in question to an adjacent plate using plate abuttal and brazing as described herein.

These connected ridge-shaped reinforcement indentations may be centred, in parallel to the main plane P, with respect to a main plane P centre point of the bridge-shaped indentation in the general flow direction D, or, alternatively, be offset therefrom in the general flow direction D.

Apart from generally reinforcing the plate and the stack structure, such reinforcement indentations cause each individual plate to be able to carry more weight, in the preferred case in which the reinforcement indentation crest point is a brazing joint to an adjacent plate, and in particular in case the reinforcement ridges and the said brazing joints are aligned across several or all plates in the height direction. This way, more plates can be arranged in the same stack vertically and thus larger heat exchangers can be made.

As described above, the ridge-shaped indentations 120; 220; 320; 420; 520; 620, form the first medium closed channels 105'-105"; 205'; 305'-305"; 405'-405"; 505'-505"; 605'-605". Specifically, and as shown in the Figures for plates 110, 310, 410, 510 and 610, the ridge-shaped indentations are preferably arranged to form at least two, preferably at least three, parallel closed flow channels 105'-105"; 305'-305"; 405'-405"; 505'-505"; 605'-605" for the first medium, each running from the first medium plate inlet 111; 311; 411; 511; 611 to the first medium plate outlet 112; 312; 412; 512; 612. Since the plate first medium inlet is connected to the first medium main inlet 101; 301, and since the plate first medium outlet is connected to the first medium main outlet 102; 302, the parallel closed flow channels 105'-105"; 305'-305"; 405'-405"; 505'-505"; 605'-605" together form one single, connected and closed flow channel system for the first medium between the main first medium inlet 101; 301 and the main first medium outlet 102; 302. The parallel-flow, which is preferably arranged along at least 50%, more preferably along at least 80%, of the total first medium flow length from plate inlet 111; 211; 311; 411; 511; 611 to plate outlet 112; 212; 312; 412; 512; 612, is advantageous in that it provides lower first medium pressure-drop and higher thermal efficiency in a very robust construction, and also provides better operation stability if some but not all of the channels gets clogged.

As is best illustrated in FIGS. 1*c*, 2*c*, 3*c*, 4*c*, 5*c* and 6*c*, the said first medium closed channel or channels 105'-105"; 205'; 305'-305"; 405'-405"; 505'-505"; 605'-605" comprise a meandering flow pattern across the plate 110; 210; 310; 410; 510; 610 in question, which meandering flow pattern is oriented in the main plane P in question. Preferably, the flow pattern preferably covers substantially the whole plate 110; 210; 310; 410; 510; 610 main plane P surface.

In other words, the ridge-shaped indentations 120; 220; 320; 420; 520; 620 are preferably distributed across substantially the whole plate 110; 210; 310; 410; 510; 610 main plane P surface. The same is preferably true regarding the bridge-shaped indentations 130; 230; 330; 430; 530; 630. This way, efficient heat exchange is achieved across the whole plate.

According to a second aspect of the present invention, the said first medium closed channel 105'-105"; 205'; 305'-305"; 405'-405"; 505'-505'; 605'-605" comprises a floor 105*a*; 205*a*; 305*a*; 405*a*; 505*a*; 605*a* and a ceiling 105*b*; 205*b*; 305*b*; 405*b*; 505*b*; 605*b*, as viewed in the height direction H. As is illustrated in FIGS. 1*a*, 1*g*-1*k*, 2*a*, 2*e* and 3*a*, the first medium closed channel 105'-105"; 205'; 305'-305" is offset from the main plane P in question, in the height direction H, along the general local flow path direction of the channel 105'-105"; 205'; 305'-305" in question, by the said floor 105*a*; 205*a*; 305*a* and said ceiling 105*b*; 205*b*; 305*b* both being offset in the same height direction H. In other words, the channel 105'-105"; 205'; 305'-305" comprises a step 105*c*; 205*c*; 305*c* in the height direction H along its flow path. Hence, the first medium channel in question comprises a height-direction H step at said offset. Preferably, the first medium channel 105'-105"; 205'; 305'-305" comprises several such steps, forming an up-and-down meandering flow path. Hence, this way a meandering flow path is achieved, which in contrast to the above described meandering across the whole plate surface meanders back and forth in the height direction H.

It is noted that such a step may preferably be formed by the said floor 105*a*; 205*a*; 305*a*; 405*a*; 605*a* and said ceiling 105*b*; 205*b*; 305*b*; 405*b*; 605*b* being offset in the same height H direction at the same or substantially the same location along the channel 105'-105"; 205'; 305'-305"; 405'-405"; 605'-605" in question. However, such offsets may also be offset in relation to each other in the channel longitudinal direction.

Furthermore, as is best illustrated in FIGS. 5*c* and 6*c*, the first medium closed channel 505'-505'; 605'-605" preferably comprises back-and-forth steps or offsets 505*d*; 605*d* in the main plane P, which steps 505*d*; 605*d* are preferably arranged in the said local second medium flow direction D.

Hence, three different types of meandering flow patterns have been described in relation to the first medium closed channels 105'-105"; 205'; 305'-305"; 405'-405"; 505'-505'; 605'-605'". One which is global, meandering across the whole plate in question; one 105*c*; 205*c*; 305*c* which is locally arranged, meandering in the height direction H; and one 505*d*; 605*d* which is locally arranged, meandering in the main plane P. It is understood that these types of meandering flow patterns are freely combinable in any combination, and that other additional meandering patterns may also be used in addition to one or more of the meandering patterns described herein.

In a particularly preferred embodiment, the said height direction H steps 105*c*; 205*c*; 305*c* of the first medium closed channel first medium closed channel 105'-105"; 205'; 305'-305" form a back-and-forth flow channel shape with respect to the main plane P (perpendicularly to the main plane P), comprising at least five steps or offsets 105*c*; 205*c*; 305*c* of opposite height direction H perpendicularly to the main plane P and substantially covering the entire flow path or each first medium flow channel between the first medium plate inlet 111; 211; 311 and the first medium plate outlet 112; 212; 312. Correspondingly, in case there are main plane P steps or offsets 505*d*; 605*d*, there are preferably at least five such steps or offsets of opposite main plane P direction, and substantially covering the entire flow path for each first medium channel between the first medium plate inlet and the first medium plate outlet.

According to a very preferred embodiment, the ridge-shaped indentations 120; 220; 320; 420; 520; 620 and the bridge-shaped indentations 130; 230; 430; 530; 630 form a pattern of indentations that preferably covers substantially the whole plate 110; 210; 310; 410; 510; 610 surface. However, depending on the detailed design of said pattern, certain areas of the plate surface may be unoccupied by said indentation pattern. Then, it is preferred that such unoccupied areas are substantially covered by additional indentations 140; 240; 340; 440; 540; 640, preferably in the form of dimples in a way so that corresponding dimples of adjacently arranged plates 104*a*, 104*b*; 204*a*, 204*b*; 304*a*, 304*b* of plate pairs are in direct contact with each other in said stack, being fastened/brazed together in said heat exchanger 100; 200; 300. The Figures provide numerous examples of such additional indentations 140; 240; 340; 440; 540; 640, which are hence indentations neither being of the above-discussed ridge type or bridge type.

Such additional indentations 140; 240; 340; 440; 540; 640 provide improved mechanical stability to the stack. However, according to a preferred embodiment, the plate 110; 210; 310; 410; 510; 610 comprises additional indentations 140; 240; 340; 440; 540; 640 of said type arranged at locations not occupied by the bridge-shaped 120; 220; 320; 420; 520; 620 or ridge-shaped 130; 230; 330; 430; 530; 630 indentations, additionally arranged to increase the flow-through of the second medium through the through holes 132*a*, 132*b*; 232*a*, 232*b*; 332*a*, 332*b*; 432*a*, 432*b*; 532*a*, 532*b*; 632*a*, 632*b* of said bridge-shaped indentations 130; 230; 330; 430; 530; 630. This flow-through increase is achieved by the positioning of the said additional indentations 140; 240; 340; 440; 540; 640 in relation to the other indentions 120, 130; 220, 230; 320, 330; 420, 430; 520, 530; 620, 630, by increasing flow resistance for the second medium across said unoccupied locations, specifically by, as a result of their presence, forcing the second medium to the said through holes. For instance, additional indentations 140; 240; 340; 440; 540; 640 may be arranged in locations where relatively large amounts of second medium would flow in case bridge-shaped indentations were to be arranged there instead of said additional indentations 140; 240; 340; 440; 540; 640, thereby forcing an even flow of the second medium across the plate in question. Specifically, such additional indentations 140; 240; 340; 440; 540; 640 may advantageously be arranged along the peripheral sides of the plate 110; 210; 310; 410; 510; 610, in the main plane P.

The additional indentations 140; 240; 340; 440; 540, 640 may also serve an aligning purpose, in the sense that they align the plate pairs 104*a*, 104*b*; 204*a*, 204*b*; 304*a*, 304*b* in relation to each other. This is, for instance, shown in the four corner indentations in plate 100.

It is preferred that there are more ridge-shaped indentations 130; 230; 330; 430; 530; 630 than additional indentations 140; 140; 340; 440; 540; 640 on each plate 110; 210; 310; 410; 510; 610.

The first and second media may each, independently of each other, be a liquid or a gas, and/or transition from one to the other as a result of a heat exchanging action taking place between said media using a heat exchanger according to the invention.

According to a preferred embodiment, however, the first medium is a liquid or a gas, preferably a liquid, and the second medium is a gas. In particular, the first medium may be water or brine, while the second medium is steam or air.

Preferably, the first medium inlet 111; 211; 311; 411; 511; 611 and outlet 112; 212; 312; 412; 512; 612 are preferably of roughly equal size, and may preferably be circular or rectangular of shape.

Regarding the respective first medium inlets 111; 211; 311; 411; 511; 611 of the individual plates 110; 210; 310; 410; 510; 610, in a preferred embodiment the respective inlet hole has a varying cross-sectional size. In particular, it is preferred that plates arranged closer to the first medium main inlet 101; 201; 301 have smaller first medium inlets 111; 211; 311; 411; 511; 611 than plates arranged further from the first medium main inlet 101; 201; 301. This provides better first medium distribution in the heat exchanger 100; 200; 300.

As described above, there are separate flow channels for the first medium 105'-105"; 205'; 305'-305"; 405'-405"; 505'-505"; 605'-605" and for the second medium 106; 206; 306; 406; 506; 606. Preferably, the second medium flow channels have an interior flow height, in the height direction H, which is at least equal to, preferably at least larger than, preferably at least twice, preferably at least three times, the interior flow height, in the height direction H, of the first medium flow height.

All ridge-shaped indentations 120; 220; 320; 420; 520; 620 are preferably of the same or substantially the same height, in the height direction H, across each plate 110; 210; 310; 410; 510; 610. It is noted, however, that steps 105*c*, 205*c*, 305*c* may displace these heights locally.

The flow channels 105'-105"; 205'; 305'-305"; 405'-405"; 505'-505"; 605'-605" are preferably between 3 and 15 mm, preferably between 4 and 8 mm, wide, at their widest point and as seen in the main plane P.

In a particularly preferred embodiment, the said first medium flow height, of the first medium flow channel 105'-105"; 205'; 305'-305"; 405'-405"; 505'-505"; 605'-605", is at the most 3 mm, preferably at the most 2.0 mm, preferably at the most 1.5 mm, but preferably at least 0.8 mm.

All bridge-shaped indentations 130; 230; 330; 430; 530; 630 are preferably of the same height, in the height direction H, across each plate 110; 210; 310; 410; 510; 610. This height is preferably at least 0.75 mm, more preferably at least 1.5 mm, most preferably at least 2 mm; and preferably at the most 4.5 mm, more preferably at the most 4 mm, from the main plane P, in the height direction H. Preferably, at least the majority, preferably substantially all, preferably all, bridge-shaped indentations 130; 230; 330; 430; 530; 630 are also higher, in the opposite or, preferably, the same, height direction H than at least the majority, preferably substantially all, preferably all, of the ridge-shaped indentations 120; 220; 320; 420; 520; 620. The height difference between a or, preferably, each, bridge-shaped indentation 130; 230; 330; 430; 530; 630 and respective ridge-shaped indentations 120; 220; 320; 420; 520; 620 arranged adjacent to, or in the vicinity of, the said bridge-shaped indentation in question, is preferably at least 0.5 mm, preferably at least 1.0 mm.

The corresponding also applies to the additional indentations 140; 240; 340; 440; 540; 640. The metal sheet material is preferably between 0.15 mm and 0.5 mm thick.

Preferably, the ridge-shaped indentations 120, 220, 320, 420, 520, 620 are at least 0.2 mm, more preferably at least 0.4, more preferably at least 0.8 mm; and at the most 2.5 mm, more preferably at the most 2 mm high, in the height direction H.

As described above, the plates 110; 210; 310; 410; 510; 610 together form a stack of a heat exchanger by being fastened/brazed together in the stack structure in question, so that corresponding ones of said indentations 120, 130, 140; 220, 230, 240; 320, 330, 340; 420, 430, 440; 520, 530, 540; 620, 630, 640 of adjacent plates 110; 210; 310; 410; 510; 610 are fastened/brazed together. This forms a very sturdy construction, without risking the integrity of the complicated channels formed between said indentations. In particular, the plates 110; 210; 310; 410; 510; 610 may be manufactured from stainless steel, and are fastened/brazed together using copper or nickel. However, the plates 110; 210; 310; 410; 510; 610 are preferably manufactured from aluminium, and fastened/brazed together using aluminium. In practise, plates 110; 210; 310; 410; 510; 610 are arranged in the said stack structure, with brazing foil material in between in case such foil material is used. Then, the whole stack is subjected to heat in a furnace, causing the brazing material to melt and permanently join the plates 110; 210; 310; 410; 510; 610 together via the above described indentations. In the preferred case where all indentations bulge out in the same height direction H, brazing is performed between some plates arranged directly main plane P against main plane P.

In particular, a heat exchanger 100; 200; 300 according to the invention may preferably be a counter- or parallel flow heat exchanger. Preferably, it is maximally 1 meter in its longest dimension.

Above, preferred embodiments have been described. However, it is apparent to the skilled person that many modifications can be made to the disclosed embodiments without departing from the basic idea of the invention.

The six detailed embodiments that have been presented and illustrated in the Figures have been selected to illustrate various aspects of the present invention. It is understood that various design aspects comprised in each individual such example can be combined freely and as applicable, and that plates according to the invention may also comprise additional design details, in addition to the ones described above.

The plates 110; 210; 310; 410; 510; 610 illustrated in the Figures do not explicitly feature any inlet or outlet for the second medium. Rather, the second medium can flow in and out from the stack via open edges 103; 203; 3063. It is realized, however, that inlet and outlet holes for the second medium may also be present in the plates.

Furthermore, above three different aspects of the present invention have been described. It is understood that they represent different but mutually compatible perspectives of the present invention, and that they are freely combinable one with the other.

Hence, the invention is not limited to the described embodiments, but can be varied within the scope of the enclosed claims.

The invention claimed is:

1. A heat exchanger for heat exchange between a first medium and a second medium, comprising a main inlet for the first medium;

a main outlet for the first medium; and a plurality of heat exchanging plates, the plurality of heat exchanging plates are associated with a respective parallel main plane of extension and a height direction perpendicular to said main plane, and wherein each of the plurality of heat exchanging plates comprise:

a plate inlet for the first medium, connected to the main inlet for the first medium;

a plate outlet for the first medium, connected to the main outlet for the first medium; and a respective first heat transfer surface on a first side of the plate and arranged to be in contact with the first medium flowing along said first side;

a respective second heat transfer surface on a second side of the plate and arranged to be in contact with the second medium flowing along said second side;

a respective plurality of indentations in the plate, formed by a material of the plate bulging out locally in the height direction;

wherein the plurality of heat exchanging plates are fastened together in a stack on top of each other with their respective main planes parallelly arranged, and the plurality of heat exchanging plates comprise heat exchanging plates of a first type and heat exchanging plates of a second type arranged alternatingly, so that corresponding ones of said indentations of adjacent plates are arranged in direct contact with each other, so that at least one of corresponding first and second surfaces of adjacent plates abut each other via said indentations and so that flow channels for said first and second media are formed between said surfaces, wherein each plate of the first type comprises:

a respective ridge-shaped indentation, arranged to form, together with a corresponding ridge-shaped indentation of an adjacent plate of the second type, at least one closed flow channel for the first medium from the first medium plate inlet to the first medium plate outlet, and a respective bridge-shaped indentation, formed to comprise a through hole through the plate of the first type and arranged to form, together with a corresponding bridge-shaped indentation of an adjacent plate of the second type, an open flow channel for the second medium, and wherein said open flow channel communicates with corresponding open flow channels between other pairs of first and second type plates.

2. The heat exchanger according to claim 1, wherein a maximum height of said ridge-shaped indentations is lower than a corresponding maximum height of the bridge-shaped indentations, and wherein each plate of the first type is fastened to a respective plate of the second type via at least a plurality of contact points between respective crest points of the bridge-shaped indentations.

3. The heat exchanger according to claim 1, wherein a plurality of the ridge-shaped indentations bulge out on the same side of the main plane as a plurality of the bridge-shaped indentations.

4. The heat exchanger according to claim 3, wherein a respective crest point of the ridge-shaped indentations of plates of the first type does not come into direct contact with any crest points of corresponding ridge-shaped indentations of plates of the second type.

5. The heat exchanger according to claim 3, wherein each plate of the first type is fastened together with an adjacent plate of the second type by abuttal of a non-indented part of the first plate first heat transfer surface to a corresponding non-indented part of the second plate first heat transfer surface.

6. The heat exchanger according to claim 1, wherein the bridge-shaped indentations comprise two through holes in the corresponding plate of the first type, as well as a bridge part forming a passage between the through holes, and wherein the passage has a general direction being parallel to a general flow direction of the second medium past the bridge-shaped indentation.

7. The heat exchanger according to claim 6, wherein respective passages formed by respective bridge-shaped indentations arranged after one another in the general flow direction are offset in a direction in the main plane which is perpendicular to said general flow direction, so that passages adjacently arranged in said general flow direction are not aligned in said perpendicular direction and along the flow direction.

8. The heat exchanger according to claim 6, wherein the general flow direction is perpendicular to a general direction of a closed flow channel for the first medium arranged adjacent to the bridge-shaped indentation.

9. The heat exchanger according to claim 1, wherein the plurality of heat exchanging plates comprise ridge-shaped first reinforcement indentations running between adjacent bridge-shaped indentations, connecting different ones of said bridge-shaped indentations.

10. The heat exchanger according to claim 1, wherein the bridge-shaped indentations comprise ridge-shaped second reinforcement indentations running across the bridge-shaped indentation, from a first side of the bridge-shaped indentation to an opposite second side of the bridge-shaped indentation.

11. The heat exchanger according to claim 9, wherein the first and second ridge-shaped reinforcement indentations with respect to each bridge-shaped indentation are connected, forming a connected ridge-shaped reinforcement indentation running both between and across bridge-shaped indentations, for several adjacent bridge-shaped indentations.

12. The heat exchanger according to claim 1, wherein the ridge-shaped indentations forming the first medium closed channel are arranged to form at least two parallel closed flow channels for the first medium, each running from the first medium plate inlet to the first medium plate outlet.

13. The heat exchanger according to claim 1, wherein the first medium closed channel comprises a meandering flow pattern across the corresponding plate.

14. The heat exchanger according to claim 1, wherein the first medium closed channel comprises a floor and a ceiling, as viewed in the height direction, and wherein the first medium closed channel comprises a step in the height direction along its flow path by the floor and said ceiling both being offset in the same height direction.

15. The heat exchanger according to claim 14, wherein the height direction steps of the first medium closed channel form a back-and-forth flow channel shape with respect to the main plane, comprising at least five steps of opposite direction perpendicularly to the main plane and covering the entire flow path between the first medium plate inlet and the second medium plate outlet.

16. The heat exchanger according to claim 1, wherein at least one plate of the plurality of heat exchanging plates comprises additional indentations at locations not occupied by the bridge-shaped or ridge-shaped indentations, arranged to increase the flow-through of the second medium through the bridge-shaped through holes, by increasing flow resistance for the second medium across said unoccupied locations.

* * * * *